US006956794B2

(12) United States Patent
Nakamura et al.

(10) Patent No.: US 6,956,794 B2
(45) Date of Patent: Oct. 18, 2005

(54) ELECTRONICALLY CONTROLLED TIMEPIECE, AND POWER SUPPLY CONTROL METHOD AND TIME CORRECTION METHOD THEREFORE

(75) Inventors: Hidenori Nakamura, Suwa (JP); Kunio Koike, Suwa (JP); Eisaku Shimizu, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 253 days.

(21) Appl. No.: 10/361,074

(22) Filed: Feb. 6, 2003

(65) Prior Publication Data

US 2003/0128631 A1 Jul. 10, 2003

Related U.S. Application Data

(62) Division of application No. 09/554,963, filed as application No. PCT/JP99/05171 on Sep. 21, 1999, now Pat. No. 6,757,220.

(30) Foreign Application Priority Data

Sep. 22, 1998 (JP) ..... 10-268529
Mar. 8, 1999 (JP) ..... 11-060463
Aug. 10, 1999 (JP) ..... 11-226534

(51) Int. Cl.[7] ..... G04C 3/00
(52) U.S. Cl. ..... 368/203
(58) Field of Search ..... 368/203–205, 368/76, 64; 320/103, 148, 149, 152, 155, 166, 167

(56) References Cited

U.S. PATENT DOCUMENTS 3,787,783 A * 1/1974 Kettere ..... 331/116 M
4,196,578 A 4/1980 Besson
4,295,215 A 10/1981 Kitai et al.
4,730,287 A * 3/1988 Yoshino et al. ..... 368/205
4,785,435 A * 11/1988 Inoue et al. ..... 368/205
5,701,278 A * 12/1997 Higuchi et al. ..... 368/204
5,798,985 A * 8/1998 Nakajima ..... 368/64
6,113,259 A 9/2000 Farine et al.
6,563,766 B1 * 5/2003 Nakamiya ..... 368/64
6,584,043 B1 * 6/2003 Koike et al. ..... 368/204
6,628,572 B1 * 9/2003 Yabe et al. ..... 368/204
6,693,852 B2 * 2/2004 Koike et al. ..... 368/204

FOREIGN PATENT DOCUMENTS

JP 5-79493 10/1993
JP 8-5758 1/1996
JP 8-75874 3/1996
JP 10-300862 11/1998

* cited by examiner

*Primary Examiner*—Kamand Cuneo
*Assistant Examiner*—Jeanne-Marguerite Goodwin
(74) *Attorney, Agent, or Firm*—Rosalio Haro

(57) ABSTRACT

An electronically controlled timepiece includes an analog circuit (160) driven by a power source (22), a logic circuit (170) driven by a constant voltage regulator circuit (161) forming part of the analog circuit, an oscillator circuit (51) driven by the constant voltage regulator, a power source switch (162) for cutting off the supply of power to the analog circuit other than the constant voltage regulator circuit from the power source during a time correction operation, and a clock cutoff gate (171) for cutting off a clock input from the oscillator circuit to the logic circuit. During the time correction operation, power consumption is reduced because only the oscillator circuit and the constant voltage regulator circuit are operative. The oscillator circuit is not suspended, and an error in time display is eliminated.

28 Claims, 28 Drawing Sheets

WAVE SHAPING CIRCUIT
ROTATION DETECTION
INITIALIZING CIRCUIT
INDICATION ERROR CORRECTOR UNIT
OSCILLATOR CIRCUIT
CRYSTAL OSCILLATOR
FREQ DIVIDER
LOAD
UP
DOWN
CLE
VDD
VSS
SR
FG1
MG1
MG2
CH1
CH2
CH3
LBS
1024Hz
256Hz
128Hz
512Hz
8Hz
fs
50
56
70
80
200

FIG. 14

INITIAL VALUE AT UP/DOWN COUNTER

| | | OUTPUT VALUE OF A/D CONVERTER AT VOLTAGE DETECTOR SIDE | | | | | |
|---|---|---|---|---|---|---|---|
| | | 0~4 | 5~9 | 10~14 | 15~19 | 20~24 | 25~31 |
| OUTPUT VALUE OF A/D CONVERTER AT TEMPERATURE SENSOR SIDE | 0~4 | 15 | 15 | 15 | 13 | 12 | 12 |
| | 5~9 | 15 | 15 | 15 | 13 | 12 | 11 |
| | 10~14 | 15 | 15 | 15 | 12 | 11 | 11 |
| | 15~19 | 15 | 15 | 13 | 12 | 11 | 11 |
| | 20~24 | 15 | 15 | 12 | 11 | 11 | 11 |
| | 25~31 | 15 | 13 | 12 | 11 | 11 | 11 |

FIG. 17

| OUTPUT VALUES | TEMPERATURE(°C) | VOLTAGE (V) |
|---|---|---|
| | ≤ ~ < | ≤ ~ < |
| 0 | ~ -36 | ~ 0.62 |
| 1 | -36 ~ -32 | 0.62 ~ 0.64 |
| 2 | -32 ~ -28 | 0.64 ~ 0.66 |
| 3 | -28 ~ -24 | 0.66 ~ 0.68 |
| 4 | -24 ~ -20 | 0.68 ~ 0.70 |
| 5 | -20 ~ -16 | 0.70 ~ 0.72 |
| 6 | -16 ~ -12 | 0.72 ~ 0.74 |
| 7 | -12 ~ -8 | 0.74 ~ 0.76 |
| 8 | -8 ~ -4 | 0.76 ~ 0.78 |
| 9 | -4 ~ 0 | 0.78 ~ 0.80 |
| 10 | 0 ~ 4 | 0.80 ~ 0.82 |
| 11 | 4 ~ 8 | 0.82 ~ 0.84 |
| 12 | 8 ~ 12 | 0.84 ~ 0.86 |
| 13 | 12 ~ 16 | 0.86 ~ 0.88 |
| 14 | 16 ~ 20 | 0.88 ~ 0.90 |
| 15 | 20 ~ 24 | 0.90 ~ 0.92 |
| 16 | 24 ~ 28 | 0.92 ~ 0.94 |
| 17 | 28 ~ 32 | 0.94 ~ 0.96 |
| 18 | 32 ~ 36 | 0.96 ~ 0.98 |
| 19 | 36 ~ 40 | 0.98 ~ 1.00 |
| 20 | 40 ~ 44 | 1.00 ~ 1.02 |
| 21 | 44 ~ 48 | 1.02 ~ 1.04 |
| 22 | 48 ~ 52 | 1.04 ~ 1.06 |
| 23 | 52 ~ 56 | 1.06 ~ 1.08 |
| 24 | 56 ~ 60 | 1.08 ~ 1.10 |
| 25 | 60 ~ 64 | 1.10 ~ 1.12 |
| 26 | 64 ~ 68 | 1.12 ~ 1.14 |
| 27 | 68 ~ 72 | 1.14 ~ 1.16 |
| 28 | 72 ~ 76 | 1.16 ~ 1.18 |
| 29 | 76 ~ 80 | 1.18 ~ 1.20 |
| 30 | 80 ~ 84 | 1.20 ~ 1.22 |
| 31 | 84 ~ | 1.22 ~ |

ELECTRONICALLY CONTROLLED TIMEPIECE, AND POWER SUPPLY CONTROL METHOD AND TIME CORRECTION METHOD THEREFORE

CONTINUING APPLICATION DATA

This application is a divisional of U.S. patent application Ser. No. 09/554,963 (now U.S. Pat. No. 6,757,220), filed Jul. 28, 2000, which is a 371 of PCT/JP99/05171, filed Sep. 21, 1999, each of which is incorporated herein in its entirety by reference.

BACKGROUND OF THE INVENTION

1. Field of the Invention

The present invention relates to an electronically controlled timepiece that controls timepiece hand driving in response to a signal, as a reference, from an oscillator circuit that employs a time standard source such as a crystal oscillator, a power supply control method for the electronically controlled timepiece and a time correction method for the electronically controlled timepiece.

2. Description of the Related Art

In one of known electronically controlled mechanical timepieces that are controlled by making use of an IC or a crystal oscillator, a generator converts, into electrical energy, mechanical energy released by a mainspring, the electrical energy drives a rotation controller, which controls a current flowing through a coil of the generator, and hands secured to train wheels that transmit the mechanical energy from the mainspring to the generator are accurately driven to indicate accurate time.

Electrical energy from the generator is once stored in a smoothing capacitor, and the power from the capacitor drives the rotation controller. Since the capacitor is supplied with an alternating-current electromotive force in synchronization with the rotation period of the generator, it is not necessary to store power for a long period of time to enable the rotation controller having an IC or a crystal oscillator to operate. Conventionally, a relatively small capacitance capacitor enabling the IC or the crystal oscillator to operate for several seconds, i.e., a capacitor of 10 $\mu$F or so is employed.

The electronically controlled mechanical timepiece needs no motor because the mainspring is a power source for driving timepiece hands, and is low cost with a small component count. It is sufficient if a small amount of electrical energy needed to drive an electrical circuit is generated. A small input energy is enough to drive the timepiece.

The electronically controlled mechanical timepiece has the following drawback. When a time correction operation (a timepiece hand setting operation) is performed with the crown pulled out, each of an hour hand, a minute hand, and a second hand is stopped to set an accurate time. The stop of the hands stops train wheels, and thus the generator as well.

The input of the electromotive force to the smoothing capacitor from the generator is suspended, while the IC is continuously driven. The charge stored in the capacitor is discharged to the IC side, and a voltage across terminals of the IC gradually drops. The voltage applied to the IC thus drops below an oscillation stop voltage (Vstop, for instance, 0.6 V), leading to the stop of the rotation controller.

When the oscillation of the IC stops, the power consumption is reduced, and the voltage drop rate in the capacitor also becomes slow. When the time correction operation takes time long enough to cause the voltage of the capacitor to drop below the oscillation stop voltage, the capacitor typically falls to a voltage of 0.3 to 0.4 V slightly lower than the oscillation stop voltage. When the time correction operation (hand setting time) becomes excessively long, to several minutes, for instance, the capacitor is fully discharged with the voltage thereof dropped to zero V.

Even if the generator starts rotating with the crown pushed into after the hand setting, the capacitor, the voltage of which has once dropped below the oscillation stop voltage as a result of discharge, takes time before the capacitor is charged again to be high enough to reach a drive start voltage (voltage capable of driving the IC) for the rotation controller. The IC (an oscillator circuit) remains inoperative throughout, and no accurate time control is performed.

Specifically, when the crown is pulled out to a second step (for a hand setting mode) from a zero step (for a normal hand driving mode) or from a first step (for a calendar correction mode) at time point A as shown in FIG. 26, the rotor of the generator stops, stopping charging a capacitor C1. On the other hand, the capacitor C1 continuously feeds electrical energy to the rotation controller (including a "drive IC" in a drive circuit for driving the crystal oscillator as a time standard source), thereby allowing the crystal oscillator to continuously oscillate.

The voltage of the power source capacitor C1 gradually drops. At time point B1 (within three minutes from time A, for instance), the hand setting operation ends, and the crown is pushed in, moving from the second step to the first step or zero step (for the normal operation). The generator becomes operative again, restarting the charging of the power source capacitor C1, and raising the voltage of the power source capacitor C1. In this case, the oscillation of the crystal oscillator continuously oscillates, the drive circuit (the rotation controller) quickly resumes rotation control of the rotor (brake control), and an indication error subsequent to the hand setting becomes zero.

When the hand setting operation is prolonged to be longer than three minutes, for instance, the voltage of the capacitor C1 drops below the oscillation stop voltage (Vstop, 0.6 V, for instance) of the drive circuit, and the oscillation stops at time B2 at the moment the hand setting operation ends. Even if the crown is moved to the first step at point B2, the rotation controller takes the sum of time T1 and time T2 before it resumes rotation control of the rotor, leading to an indication error.

The time T1 is a duration of time, during which the power source capacitor C1 is charged to a voltage (Vstart) on which the drive circuit and the oscillator circuit in the rotation controller normally operate. The voltage Vstart is typically higher than the voltage Vstop, and is 0.7 V, for instance.

The time T2 is a duration of time from the application of the oscillation start voltage (Vstart) until the oscillator circuit starts oscillating. The time T2 becomes longer as the voltage of the power source capacitor C1 is lower, and ranges from several seconds to several minutes, as shown in FIG. 27. For instance, when the oscillation start voltage (Vstart=0.7 V) is reached with the power source capacitor C1 gradually charged, the time T2 is approximately 20 seconds with the voltage (0.7 V) applied thereto.

When the hand setting operation takes time, the voltage of the power source capacitor C1 drops, thereby stopping the oscillation. Subsequent to the end of the hand setting operation, the oscillator circuit takes time T1+T2 before the start of the oscillation. Because of a lower voltage applied thereto, the oscillator circuit takes several seconds to several minutes for T2 alone. Before the start of the oscillation, the rotation of the rotor is not controlled. The hands gain or lose time, suffering from a substantial indication error.

The use of a large capacitance capacitor C1 to permit a longer hand setting time is contemplated. The oscillator circuit is thus prevented from stopping even if the hand setting takes three minutes or longer.

The use of a large capacitance capacitor slows the rise rate of the power source voltage. When the mainspring is released and stopped, it takes a long time to increase the voltage across the capacitor from the state in which no charge is stored in the power source capacitor. For a long time from the start of tightening of the mainspring to the rise of the power source voltage, the hands remain unable to present accurate time. In this case, there is a possibility that the user may mistake the state for a timepiece failure. Increasing the capacitance of the capacitor is thus not practical.

Increasing the power generation capacity of the generator to complete charging in a short time is contemplated. This arrangement increases the size of the generator, and also needs to increase the size of the mainspring as the torque to be transferred from the mainspring for feeding mechanical energy to the generator increases. This arrangement cannot be adopted for use in wristwatches, which are subject to the limitation of area and thickness dimensions.

In some of a variety of electronically controlled timepieces, such as a self-winding generator timepiece, a solar-cell charging timepiece, a battery driven timepiece, other than the electronically controlled mechanical timepiece, an oscillator circuit or an IC is stopped during a time correction operation to reduce power consumption and to prolong operation time. In this case, it takes several seconds to several minutes for the oscillator circuit to stably operate. A time error is also introduced.

It is an object of the present invention to provide an electronically controlled timepiece, a power supply control method for the electronically controlled timepiece, and a time correction method for the electronically controlled timepiece.

SUMMARY OF THE INVENTION

An electronically controlled timepiece of the present invention which includes a power source, an analog circuit driven by the power source, a power supply circuit for a logic circuit arranged in the analog circuit, the logic circuit driven by the output of the power supply circuit therefor, and an oscillator circuit driven by the output of the power supply circuit for the logic circuit. The electronically controlled timepiece further includes a power source switch for suspending the supply of electrical energy to the analog circuit other than the power supply circuit for the logic circuit from the power source during a time correction operation of the electronically controlled timepiece, and clock input limiting means for suspending a clock input from the oscillator circuit to the logic circuit during the time correction operation.

In accordance with the present invention, the power source switch suspends the supply of electrical energy from the power source, such as a capacitor or a battery, to the analog circuit other than the power supply circuit for the logic circuit during the time correction operation (hand setting operation), and the clock limiting means suspends the clock input from the oscillator circuit to the logic circuit. During the hand setting operation, only both the oscillator circuit and the power supply circuit for the logic circuit required to drive the oscillator circuit are driven with the remaining circuits all inoperative. With this arrangement, power consumption during the hand setting operation is reduced. When the capacitance of the capacitor is small, the voltage drop in the power source capacitor is limited during a typical hand setting operation (for instance, 3 to 5 minutes), and the driving of the oscillator circuit is continuously performed. With the oscillator circuit continuously operating during the hand setting operation, a normal control operation is quickly resumed after the hand setting operation, and the indication error at the shifting back from the hand setting operation is eliminated. With the power consumption reduced, there is no need for a large-sized generator, and the present invention is implemented in a wristwatch, which is typically subject to the limitation of area and thickness dimensions.

The power supply circuit for the logic circuit employs a constant voltage regulator.

The electronically controlled timepiece preferably includes logic circuit initializing means for initializing the internal status of the logic circuit during the time correction operation (hand setting operation).

If control information prior to the hand setting operation remains in the logic circuit, governing control of a rotor is not smoothly performed at the shifting back from the hand setting operation, and the time taken before the start of the governing control may be included as an error. In contrast, if the internal status of the logic circuit is initialized when the clock input to the logic circuit is cut off at the hand setting operation, the governing control of the rotor at the shifting back from the hand setting operation is smoothly performed, and the time indication error is reliably eliminated.

An electronically controlled timepiece preferably includes an external control member for setting two-step statuses of a normal mode and a time correction mode, and an external control member detector circuit for detecting the status of the external control member, wherein the external control member detector circuit includes first and second inverters, a first signal line for connecting the output of the first inverter to the input of the second inverter, a second signal line for connecting the output of the second inverter to the input of the first inverter, and a selection switch for connecting a signal input line to one of the first and second signal lines with the external control member in the time correction mode, and for connecting the signal input line to the other of the first and second signal lines with the external control member in the other mode.

A crown detector circuit 100 shown in FIG. 28 has typically been used to detect the pulled status of the external control member such as a crown or a button. For instance, the pulled statuses of the crown of the electronically controlled mechanical timepiece include a normal zero step (in which the mainspring is tightened by turning the crown with the hands turning and the generator generating), a first step (in which a calendar is corrected by turning the crown with the hands turning and the generator generating), and a second step (in which time correction is performed by turning the crown with the rotor stopping moving, the hands motionless, and the generator not generating).

The crown detector circuit 100 includes a switch 101 which is turned on and off depending on the pulled status of the crown, two pull-down resistors 102 and 103, and an inverter 104. The gate of the pull-down resistor 102 is at a voltage VDD (high level), and the pull-down resistor 102 is normally turned on. The gate of the pull-down resistor 103 is connected to the pull-down resistor 102 through the inverter 104. The switch 101 is turned off (open) with the crown in the zero step or the first step, and is turned on with the crown in the second step (closed).

When the switch 101 is turned off with the crown in the zero step or the first step, the pull-down resistor 102 is turned on, a voltage VSS, namely, a low-level signal is input to the inverter 104, and the output signal of the inverter 104 is transitioned to a high-level signal. The pull-down resistor 103 receives, at the gate thereof, the high-level signal, thereby turning itself on.

When the switch 101 is turned on with the crown in the second step, the voltage VDD, namely, a high-level signal is input to the inverter 104, and the output of the inverter 104 is transitioned to a low-level signal. As described above, depending on the pulled status of the crown, the crown detector circuit 100 alternates between a "high-level" signal and a "low-level" signal in the output thereof, thereby detecting the position of the crown.

In the conventional crown detector circuit 100, the pull-down resistor 102 is turned on with the crown in the second step, and the pull-down resistor 102 consumes energy. Instead of the crown, a dedicated button is occasionally employed to set the hands. When the hands are set using the external control member, such as the crown or the button, an external control member detector circuit for detecting the status of the external control member has the same construction as that of the crown detector circuit 100, and thus suffers from the same problem.

In contrast, the electronically controlled timepiece having the above-described external control member detector circuit employing the logic circuit almost eliminates energy consumption by the external control member, and therefore substantially reduces power consumption during the hand setting operation.

An electronically controlled timepiece of the present invention preferably includes a mechanical energy source, a generator which is driven by the mechanical energy source, and generates an electromotive force, thereby supplying electrical energy, and a rotation controller, driven by the electrical energy, for controlling the rotation period of the generator.

In the electronically controlled timepiece, the capacitance of the capacitor as the power source is small. The power consumption for the hand setting operation is reduced with the present invention implemented, the time required for the hand setting operation is assured, and the ease of use is attained.

A power supply control method for an electronically controlled timepiece of the present invention, which includes a power source, an analog circuit driven by the power source, a power supply circuit for a logic circuit arranged in the analog circuit, the logic circuit driven by the output of the power supply circuit therefor, and an oscillator circuit driven by the output of the power supply circuit for the logic circuit, includes the step of suspending the supply of electrical energy to the analog circuit other than the power supply circuit for the logic circuit from the power source during a time correction operation of the electronically controlled timepiece, and the step of suspending a clock input from the oscillator circuit to the logic circuit during the time correction operation.

In accordance with the present invention, during the time correction operation of the electronically controlled timepiece, the supply of electrical energy to the analog circuit other than the power supply circuit for the logic circuit from the power source such as a capacitor or a battery is suspended, and the clock input from the oscillator circuit to the logic circuit is suspended. The power consumption during the hand setting operation is reduced. Even with a small capacitance capacitor, the voltage drop in the power source capacitor is limited during a typical hand setting operation (for instance, 3 to 5 minutes), and the driving of the oscillator circuit is continuously performed. At the shifting back from the hand setting operation, a normal control operation is quickly resumed after the hand setting operation, and the time indication error at the shifting back from the hand setting operation is eliminated.

During the hand setting operation of the electronically controlled timepiece, the internal status of the logic circuit is preferably initialized. If the internal status of the logic circuit is initialized when the clock input to the logic circuit is cut off at the hand setting operation, the governing control of the rotor at the shifting back from the hand setting operation is smoothly performed, and the time indication error is reliably eliminated.

An electronically controlled timepiece of the present invention, which includes a mechanical energy source, a generator, driven by the mechanical energy source, for outputting electrical energy, a storage unit for storing electrical energy output by the generator, and a rotation controller, driven by electrical energy supplied by the storage unit, for controlling the rotation period of the generator, includes a power supply control unit for suspending the supply of electrical energy from the storage unit to the rotation controller while the generator stops the operation thereof in response to the time correction operation, and an indication error corrector unit for correcting an error in time indication until the rotation controller resumes a normal operation, when the power supply control unit restarts the supply of electrical energy from the storage unit to the rotation controller in response to the operation of the generator.

In accordance with the present invention, the power supply control unit suspends the supply of electrical energy from the storage unit to the rotation controller when the generator stops the operation thereof during the time correction operation (hand setting operation). Although the oscillator circuit of the rotation controller stops operating, the storage unit is maintained in a charged state during the suspension of the operation of the generator.

Even before the generator fully reaches the operation thereof at the shifting back from the hand setting operation, the storage unit feeds electrical energy to the rotation controller to cause the rotation controller to be fully operative. A time lag prior to the operation of the rotation controller is eliminated, and an error in the time control at the hand setting operation is thus minimized. Since the voltage of the storage unit is maintained at a relatively high level, the time prior to the start of the oscillator circuit of the rotation controller is shortened, and the rotation controller is quickly set to be operative.

With the indication error corrector unit incorporated, the indication error of the hand before the normal operation of the rotation controller is corrected to the extent that the indication error is eliminated or minimized.

The indication error corrector unit may be designed to perform a constant quantity correction corresponding to a predetermined value, or may set a correction value in accordance with a voltage of the storage unit.

The indication error corrector unit may adjust a correction value by detecting temperature.

Specifically, the indication error corrector unit may include a temperature sensor, a voltage detector for measuring a voltage of the storage unit, and a correction value setter for setting a correction value based on values detected by the temperature sensor and the voltage detector.

Since the voltage of the storage unit is maintained at a certain magnitude, the time, which the oscillator circuit, with a certain voltage applied thereto, takes to start oscillation, is substantially constant. By performing a constant quantity correction corresponding to a certain value, the indication error is sufficiently reduced. When a correction value is adjusted by detecting the actual voltage of the storage unit, a highly precise correction is performed to minimize the indication error.

The time prior to the start of the oscillation with the voltage applied to the oscillator circuit varies with temperature as shown in FIG. 16. For this reason, the temperature sensor included in the electronically controlled timepiece measures temperature in the vicinity of the oscillator circuit, and the correction value is adjusted in accordance with the measured temperature. A more precise correction is thus performed. The indication error, under high temperature conditions or low temperature conditions, is thus further minimized.

The power supply control unit preferably includes a switch which is connected in series with the storage unit and is closed while the generator is running, and is opened while the generator is not running.

An electrical switch is acceptable as the switch, but a mechanically driven switch is preferable. When the electrical switch is used, the supply of power may be occasionally not completely blocked. In such a case, as well, a mere leakage current (1 nA) of a silicon diode constituting the electrical switch is discharged. The switch cutoff effect of the switch is almost identical to that of the mechanically driven switch. The use of the mechanically driven switch is preferable from the standpoint of the fully cutting off the supply of power.

The switch is preferably a mechanically driven switch that is opened when a crown remains pulled out to a time correction (hand setting) mode, and is closed when the crown is pushed into to a normal mode. With the switch opened and closed in response to the operation of the crown, the switch is interlocked with the hand setting operation.

A second storage unit (a second capacitor) is preferably connected in parallel with the storage unit. With the second storage unit arranged, power is continuously fed by the second storage even if the timepiece suffers from a mechanical shock, with the switch chattering. This arrangement prevents the rotation controller from being shut down by the chattering.

A time correction method for an electronically controlled timepiece, which includes a mechanical energy source, a generator, driven by the mechanical energy source, for outputting electrical energy, a storage unit for storing, electrical energy output by the generator, and a rotation controller, driven by electrical energy supplied by the storage unit, for controlling the rotation period of the generator, includes the step of suspending the supply of electrical energy from the storage unit to the rotation controller during a time correction operation of the electronically controlled timepiece, and the step of correcting an error in time indication until the rotation controller resumes a normal operation when the supply of electrical energy from the storage unit to the rotation controller is restarted at the end of the time correction operation.

At the end of the time correction operation, the indication error may be corrected by a constant quantity correction corresponding to a predetermined value or may be corrected by a correction value set in response to the voltage of the storage unit. At the end of the time correction operation, temperature may be detected, and the correction value may be adjusted in accordance with the detected temperature.

In accordance with the present invention, the power supply control unit suspends the supply of electrical energy from the storage unit to the rotation controller when the generator stops the operation thereof during the time correction operation. The storage unit is maintained in a charged state during the suspension of the operation of the generator. Immediately subsequent to the shifting back from the time correction operation, the storage unit feeds electrical energy to the rotation controller to cause the rotation controller to be operative. Since the applied voltage is maintained at a relatively high level, the rotation controller is quickly set to be operative, and the indication error subsequent to the time correction operation is reduced.

Furthermore, since the indication error is corrected in accordance with the voltage value of the storage unit and temperature, the indication error of the hands prior to the normal operation of the rotation controller is corrected. The indication error is thus eliminated.

An electronically controlled timepiece of the present invention, which includes a mechanical energy source, a generator, driven by the mechanical energy source, for outputting electrical energy, and a rotation controller, driven by electrical energy, for controlling the rotation period of the generator, includes a main storage unit for storing electrical energy supplied by the generator to drive the rotation controller, an auxiliary storage unit connected in parallel with the main storage unit through a mechanically driven switch that is interlocked with a time correction operation, and a charge control circuit, arranged between the main storage unit and the auxiliary storage unit, for adjusting charging currents to the main storage unit and the auxiliary storage unit, and a direction and a magnitude of a current flowing between the main storage unit and the auxiliary storage unit.

The charge control circuit preferably makes the charging current (charge quantity) to the auxiliary storage unit smaller than the charging current (charge quantity) to the main storage unit when the mechanically driven switch is closed to charge the main storage unit and the auxiliary storage unit with electrical energy from the generator, and allows the auxiliary storage unit to charge the main storage unit when the voltage of the auxiliary storage unit is higher than the voltage of the main storage unit.

Since the present invention includes the auxiliary storage unit that is disconnected from the main storage unit and the generator by the mechanically driven switch, the auxiliary storage unit is maintained in a charged state even when the generator stops the operation thereof during the time correction operation (hand setting operation) in the middle of the normal hand driving. Even if the terminal voltage across the main storage unit drops below the voltage capable of driving the rotation controller at the shifting back from the hand setting operation, a current flows from the auxiliary storage unit to the main storage unit with the mechanically controlled switch closed. With its voltage increased, the main storage unit drives the rotation controller, and a time lag prior to the operation of the rotation controller is eliminated, and an error in the time control at the hand setting operation (an error in the time indication subsequent to the time correction operation) is thus minimized.

When the hand setting operation takes time, when the timepiece has been left unattended for a long period of time to the degree that the terminal voltage across-the auxiliary storage unit drops as a result of a self-discharge, the mechanically driven switch is closed to allow a current to flow from the generator to each storage unit. In this case, the charge control circuit for adjusting the direction and the magnitude of the current makes the charging current to the main storage unit larger than the charging current to the auxiliary storage unit, and the main storage unit is charged to be high enough to quickly drive the rotation control circuit. Even after the timepiece has been left unattended for a long period of time, the rotation controller is quickly driven. An error due to a time lag prior to the start of the driving of the rotation controller is reduced, and an error in the time control during the hand setting operation is minimized.

The present invention thus assures both the startup capability subsequent to the hand setting and the accuracy of the hand setting at the same time.

Preferably, the charge control circuit composed of a passive element only is used to control the charging and discharging between the main storage unit and the auxiliary storage unit. The use of the charge control circuit composed of the passive element reduces power consumption and the generation capacity of the generator, compared to the arrangement in which a comparator, i.e., an active element, is used.

When the charging and discharging are controlled between the two storage units (such as capacitors), i.e., the main storage unit and the auxiliary storage unit, the control of the charging and discharging of the capacitor is typically performed by detecting the voltage of each capacitor using a comparator, and by using the output of the comparator to cause a switch circuit, composed of transistors, to operate. In such a timepiece, the comparator is an active element, and the comparator needs power to detect the voltage. The power consumption thus increases.

In a system, such as this timepiece, in which the generation capacity is extremely small, the generation capacity of the generator needs to be increased from a current level to supply power to the comparator. To increase the generation capacity of the generator, means for increasing torque or increasing the size of the generator itself may be contemplated.

In the former means, increasing the energy supply from the mainspring allows the mainspring to fast release. The duration of time of the releasing of the mainspring from the fully tightened position thereof is shortened. In the latter means, the size of the generator becomes large, presenting difficulty in the layout of components in a timepiece that has a limited space available. As a result, the size of the timepiece itself is increased.

Since the present invention includes the charge control circuit having the passive element, the power consumption thereof is small, compared to the arrangement in which the comparator, as an active element, is employed. A generator having a small generation capacity thus works.

The capacitance of the main storage unit is preferably set to be equal to or lower than the capacitance of the auxiliary storage unit. With this arrangement, the voltage of the main storage unit is rapidly increased by allowing the current to flow from the auxiliary storage unit when the main storage unit is discharged. The drive circuit, driven by the main storage unit, is also rapidly driven.

Preferably, the mechanically driven switch is opened during the time correction operation, and is closed at the end of the time correction.

With this arrangement, the auxiliary storage unit is reliably cut off from the rotation controller with the generator stopped during the time correction operation (hand setting operation), and the auxiliary storage unit keeps the charged state thereof for a long period of time, and a long hand setting time is thus permitted.

The charge control circuit preferably includes a resistor and a diode connected in parallel with the resistor, wherein the diode is configured with the reverse direction thereof aligned with the direction of a current charging the auxiliary storage unit from the generator and the forward direction thereof aligned with the direction of a current of the auxiliary storage unit charging the main storage unit.

When the generator charges each storage unit in this arrangement, a current flows through the auxiliary storage unit via the resistor connected in parallel with the diode. The charge quantity to the main storage unit and to the auxiliary storage unit is controlled by the resistance of the resistor. For instance, the use of a resistor having a high resistance as large as 100 MΩ allows less current to flow to the auxiliary storage unit and more current to flow to the main storage unit, thereby rapidly charging the main storage unit. By setting an appropriate resistance to the resistor, the charge quantity to the main storage unit is controlled.

At the time of the shifting back from the hand setting operation, the charging of the main storage unit by the auxiliary storage unit is performed through the diode with a small charging loss involved therein, compared to the charging performed through the resistor.

The charge control circuit may include a diode only having a reverse leakage current, and wherein the diode is configured with the reverse direction thereof aligned with the direction of a current charging the auxiliary storage unit from the generator and the forward direction thereof aligned with the direction of a current of the auxiliary storage unit charging the main storage unit.

With this arrangement, a small reverse leakage current of the diode is fed to the auxiliary storage unit when each storage unit is charged with the generator. For this reason, less current flows to the auxiliary storage unit, while more current flows to the main storage unit.

At the time of shifting back from the hand setting operation, the charging current from the auxiliary storage unit to the main storage unit is aligned with the forward direction of the diode, and the voltage drop and charging loss therethrough are thus reduced.

Furthermore, if the charging control circuit is constructed of a diode only, the component count of the charging control circuit, and thus of the timepiece, becomes smaller, leading reduced manufacturing costs.

The charge control circuit may include a resistor and a one-way element connected in parallel with the resistor, wherein the one-way element is configured to cut off a current flowing in a direction to charge the auxiliary storage unit from the generator and to conduct a current of the auxiliary storage unit flowing in a direction to charge the main storage unit. In this case, the one-way element may be a diode having no reverse leakage current.

As in the charge control circuit constructed of the diode and the resistor in parallel connection, the generator charges each of the storage units, and the auxiliary storage unit is charged through the resistor so that the charge quantity to the main storage unit is large for rapid charging. When the auxiliary storage unit charges the main storage unit, the charging is performed through the one-way element, and a charging loss to the main storage unit is minimized.

When the one-way element, such as a diode having no reverse leakage current, allowing currents flowing therethrough in one direction only, is used, an error in the charge quantity due to the reverse leakage current is not created. The charging current is thus precisely controlled.

An electronically controlled timepiece preferably includes an indication error corrector unit for correcting an error in time indication until the rotation controller resumes a normal operation when the supply of electrical energy of the main storage unit to the rotation controller is restarted with the mechanically driven switch closed.

With the indication error corrector unit incorporated, the time indication error until the rotation controller resumes the normal operation is corrected, and the indication error is eliminated or minimized.

In this case, again, the indication error corrector unit may be designed to perform a constant quantity correction corresponding to a predetermined value, or may set a correction value in accordance with a voltage of the storage unit. Furthermore, the indication error corrector unit may adjust a correction value by detecting temperature. More specifically, the indication error corrector unit may includes a temperature sensor, a voltage detector for measuring a voltage of the storage unit, a correction value setter for setting a correction value based on values detected by the temperature sensor and the voltage detector.

A power supply control method for an electronically controlled timepiece of the present invention which includes a mechanical energy source, a generator, driven by the mechanical energy source, for outputting electrical energy, and a rotation controller, driven by electrical energy, for controlling the rotation period of the generator, includes the step of arranging a main storage unit which stores electrical energy supplied by the generator to drive the rotation controller and connecting an auxiliary storage unit in parallel with the main storage unit through a mechanically driven switch, the step of opening the mechanically controlled switch during a time correction operation of the electronically controlled timepiece, and the step of flowing a current from the auxiliary storage unit to the main storage unit to charge the main storage when the voltage of the auxiliary storage unit is higher than the voltage of the main storage unit with the mechanically driven switch closed at the end of a time correction operation, and the step of making a charging current supplied from the generator to the main storage unit greater than a charging current supplied from the generator to the auxiliary storage unit when the voltage of the auxiliary storage unit is not higher than the voltage of the main storage unit.

In this arrangement as well, the main storage unit is charged to be high enough to quickly drive the rotation control circuit at the shifting back from the hand setting operation and an error due to a time lag before the start of the driving of the rotation controller is reduced, and an error in the time control during the hand setting operation (an error in the time indication subsequent to the time correction operation) is minimized.

Even after the timepiece has been left unattended for a long period of time, the rotation controller is quickly driven. An error due to a time lag before the start of the driving of the rotation controller is reduced, and an error in the time control during the hand setting operation is minimized. The present invention thus assures both the startup capability subsequent to the hand setting and the accuracy of the hand setting at the same time.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIG. 14 shows an initial value setting table in the indication error corrector unit.

FIG. 17 is a table listing inputs and outputs of an A/D converter in the indication error corrector unit.

DESCRIPTION OF THE PREFERRED EMBODIMENTS

Figure 1:
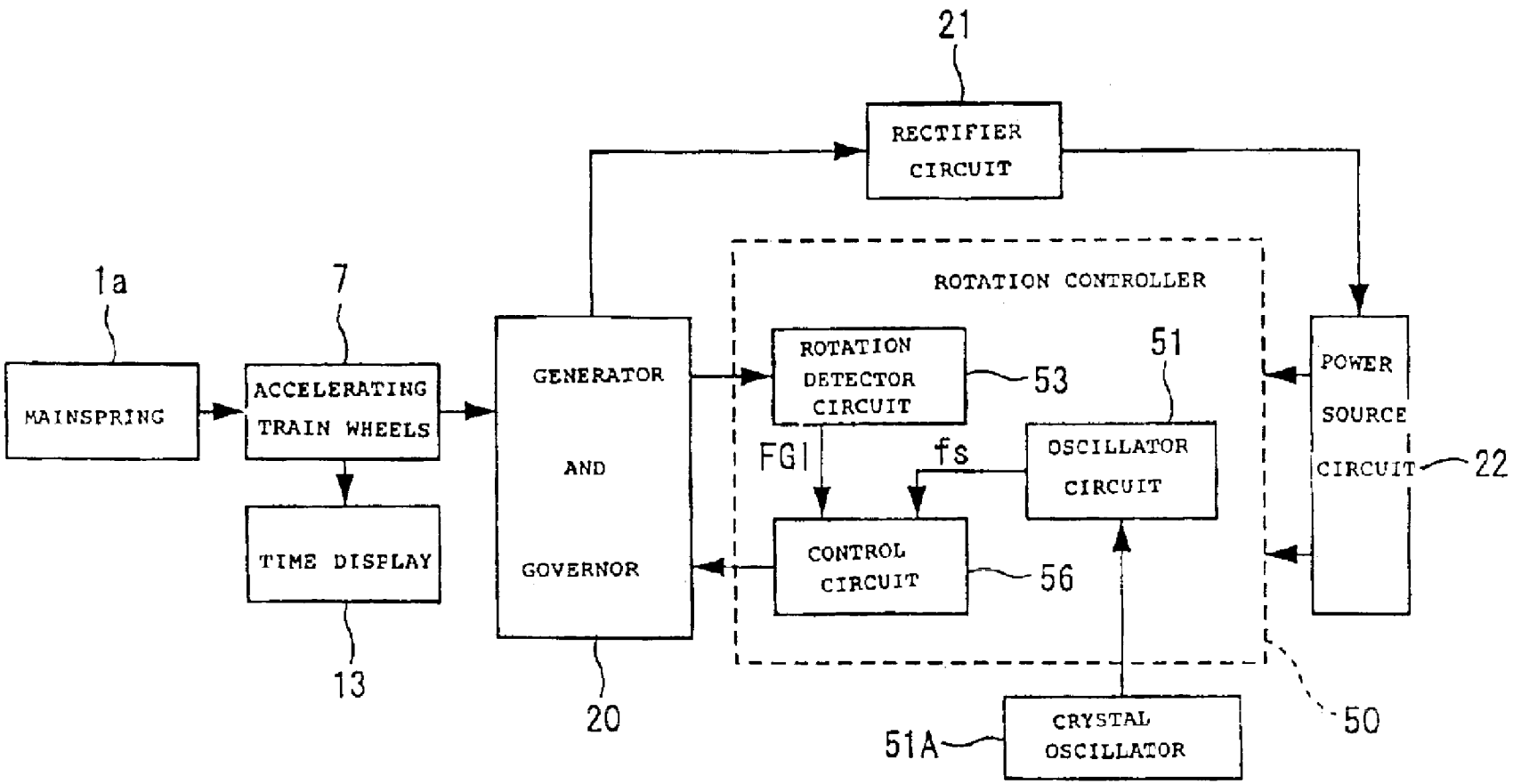
FIG. 1 is a block diagram showing the construction of an electronically controlled timepiece of a first embodiment of the present invention.

Referring to the drawings, the embodiments of the present invention are now discussed.

FIG. 1 is a block diagram showing the construction of an electronically controlled mechanical timepiece that is an electronically controlled timepiece of a first embodiment of the present invention.

The electronically controlled mechanical timepiece includes a mainspring 1*a* as a mechanical energy source, accelerating train wheels 7 as mechanical energy transmission means for transmitting torque of the mainspring 1*a* to a generator 20, and a hand 13, as a time display unit for indicating time, connected to the accelerating train wheels 7.

The generator 20 is driven by the mainspring 1*a* via the accelerating train wheels 7, and generates an electromotive force to supply electrical energy. The alternating-current output from the generator 20 is rectified by a rectifier circuit 21, which has at least one of the functions of step-up and rectification, full-wave rectification, half-wave rectification, and transistor rectification, and is stepped up as required. The alternating-current voltage is then fed to a power supply circuit 22 as a power source such as a capacitor to charge it.

Figure 2:
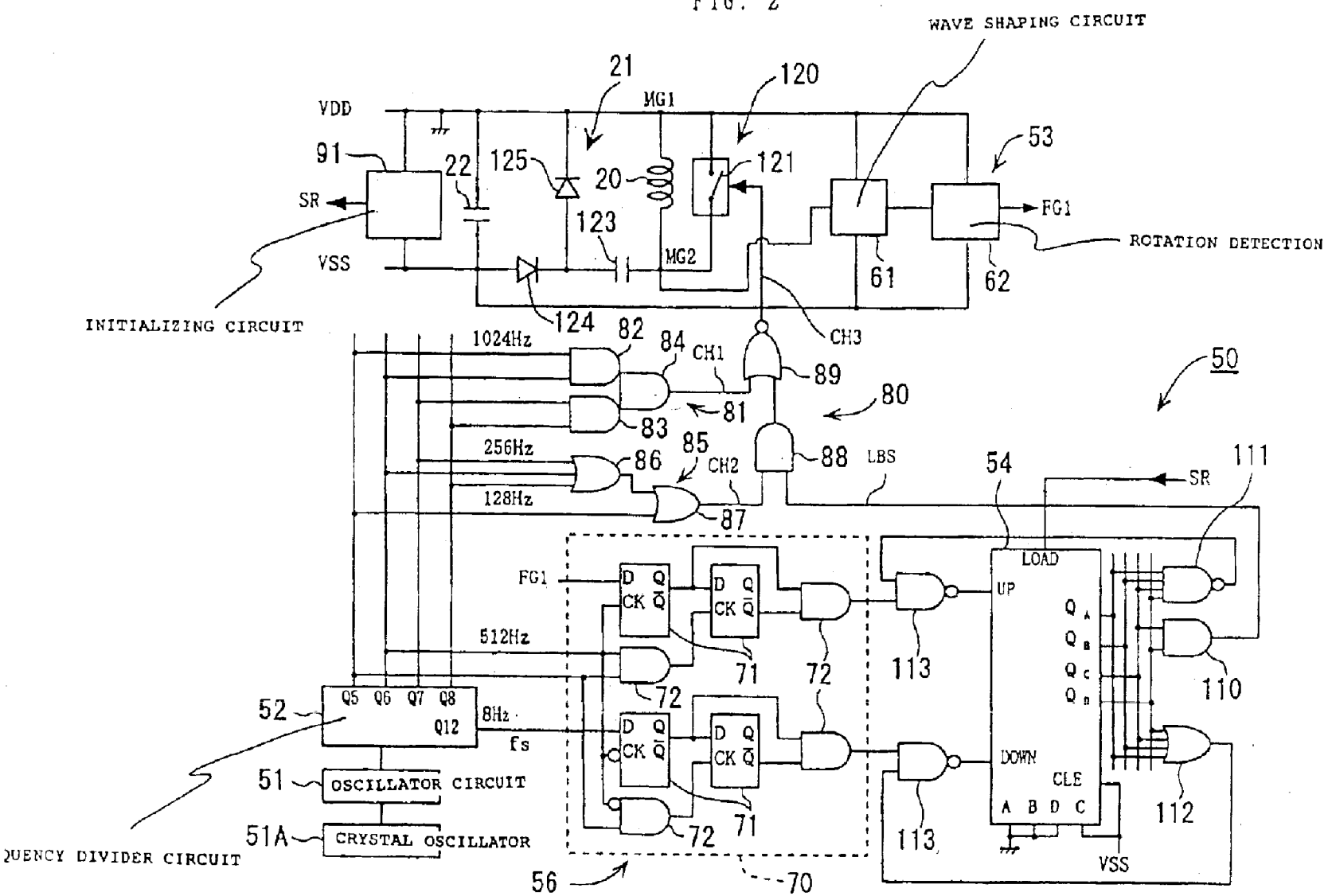
FIG. 2 is a circuit diagram showing the construction of a control circuit of the first embodiment.

Referring to FIG. 2, a brake circuit 120 is added to the generator 20 in this embodiment. Specifically, the brake circuit 120 includes a switch 121 which applies a brake by making a closed loop by shorting a first alternating-current output terminal MG1 to which the alternating-current signal (alternating current) generated by the generator 20 is output, and a second alternating-current output terminal MG2. The brake circuit 120 is assembled into the generator 20 which also works as a governor as shown in FIG. 1. The switch 121 includes an analog switch or a semiconductor switch (bilateral switch), etc, which may be opened and closed in response to a chopping signal (chopping pulse) CH3

The step-up and rectifier circuit 21 (the rectifier circuit 21 in FIG. 1) includes a capacitor 123 for voltage step-up connected to the generator 20, diodes 124 and 125, and the switch 121. The diodes 124 and 125 may be of any one-way element that allows a current to flow in one way, and the type thereof is not important. Since the electronically controlled mechanical timepiece, in particular, has a small electromotive-force generator 20, a Schottky barrier diode having a small forward voltage Vf is preferred as the diode 125. A silicon diode with a reverse leakage current thereof is preferred as the diode 124.

A direct-current signal, rectified by the rectifier circuit 21, charges a capacitor (power supply circuit) 22.

The brake circuit 120 is controlled by a rotation controller 50, which is an electronic circuit, driven by power supplied from the capacitor 22. The rotation controller 50 includes an oscillator circuit 51, a rotor rotation detector circuit 53, and a brake control circuit 56 as shown in FIG. 1 and FIG. 2.

The oscillator circuit 51 generates an oscillation signal (32768 Hz) using a crystal oscillator 61A, i.e., a time standard source, and the oscillation signal is divided into a constant period through a frequency divider 52 having twelve stages of flipflops. An output Q12 at a twelfth stage of the frequency divider 52 is output as an 8-Hz reference signal.

The rotation detector circuit 53 includes a wave shaping circuit 61 and a monostable multivibrator 62, each connected to the generator 20. The wave shaping circuit 61 is composed of an amplifier and a comparator, and converts a sine wave into a rectangular wave. The monostable multivibrator 62 functions as a bandpass filter that passes pulses having a predetermined period or shorter, and outputs a rotation detection signal FG1 with noise removed therefrom.

The control circuit 56 includes an up/down counter 54 as brake control means, a synchronization circuit 70, and a chopping signal generator 80.

The up/down counter 54 respectively receives, at an up count input and a down count input thereof, the rotation detection signal FG1 of the rotation detector circuit 53 and the reference signal fs from the frequency divider 52, via the synchronization circuit 70.

The synchronization circuit 70 is composed of four flipflops 71 and an AND gate 72, and causes the rotation detection signal FG1 to synchronize with the reference signal fs (8 Hz) using a fifth-stage output (1024 Hz) and a sixth-stage output (512 Hz) of the frequency divider 52. The synchronization circuit 70 outputs these signal pulses in a manner such that they are not concurrently output.

The up/down counter 54 is composed of a 4-bit counter. The up/down counter 54 receives, at the up count input thereof, a signal based on the rotation signal FG1 from the synchronization circuit 70, and receives, at the down count input thereof, a signal based on the reference signal fs from the synchronization circuit 70. With this arrangement, the up/down counter 54 concurrently counts the reference signal fs, the rotation signal FG1 and the difference between the two counts.

The up/down counter 54 is provided with four data input terminals (preset terminals) A through D. Terminals A, B and D are supplied with a high-level signal, setting the initial value (preset value) of the up/down counter 54 to count "11". Connected to the load input of the up/down counter 54 is an initializing circuit 91, which is connected to the capacitor 22, for outputting a system reset signal SR when power is initially fed to the capacitor 22. The initializing circuit 91 outputs a high-level signal until the charged voltage of the capacitor 22 reaches a predetermined voltage, and then outputs a low-level signal when the predetermined voltage is reached.

The up/down counter 54 does not accept the up and down inputs until the load input, i.e., the system reset signal SR is transitioned to a low level, and the up/down counter 54 is maintained at a count of "11".

The up/down counter 54 is provided with 4-bit outputs QA–QD. The third and fourth bits QC and QD output a high-level signal when the count is "12" or higher, and at least one of the third and fourth bits QC and QD necessarily outputs a low-level signal when the count is "11" or lower.

The output LBS of an AND gate 110, to which outputs QC and QD are input, is a high-level signal when the up/down counter 54 gives the count of "12" or higher, and is a low-level signal when the up/down counter 54 gives the count of "11" or lower. The output LBS is connected to the chopping signal generator 80.

The outputs of a NAND gate 111 and an OR gate 112, each receiving the outputs QA–QD, are input to each of the NAND gates 113, to which the outputs of the synchronization circuit 70 are also input. When the up count input signal is repeatedly input causing the count to reach "15", the NAND gate 111 outputs a low-level signal. Then, if a further up count input signal is input to the NAND gate 113, the input is canceled, and no further up count input signal afterward is input to the up/down counter 54. Similarly, when the count reaches "0", the OR gate 112 outputs a low-level signal, and a further down count input signal is canceled. In this way, the count is prevented from shifting "15" to "0", or shifting from "0" to "15".

The chopping signal generator 80 includes first chopping signal generating means 81, constructed of three AND gates 82–84, for outputting a first chopping signal CH1 based on the outputs Q5–Q8 of the frequency divider 52, second chopping signal generating means 85, constructed of two OR gates 86 and 87, for outputting a second chopping signal CH2 based on the outputs Q5–Q8 of the frequency divider 52, an AND gate 88 for receiving the output LBS of the up/down counter 54 and the output CH2 of the second chopping signal generating means 85, and a NOR gate 89 for receiving the output of the AND gate 88 and the output CH1 of the first chopping signal generating means 81.

The output CH3 of the NOR gate 89 in the chopping signal generator 80 is input to the gate of the switch 121 constructed of a P-channel transistor. When the CH3 is a low-level signal, the switch 121 is kept turned on, shorting the generator 20 for braking.

When the CH3 is a high-level signal, the switch 121 is kept turned off, applying no brake on the generator 20. The chopping signal from the output CH3 thus controls the generator 20 in chopping control. The rotation controller 50, including the chopping signal generator 80 outputting the chopping signal, opens or closes the switch 121 for chopping.

Figure 3:
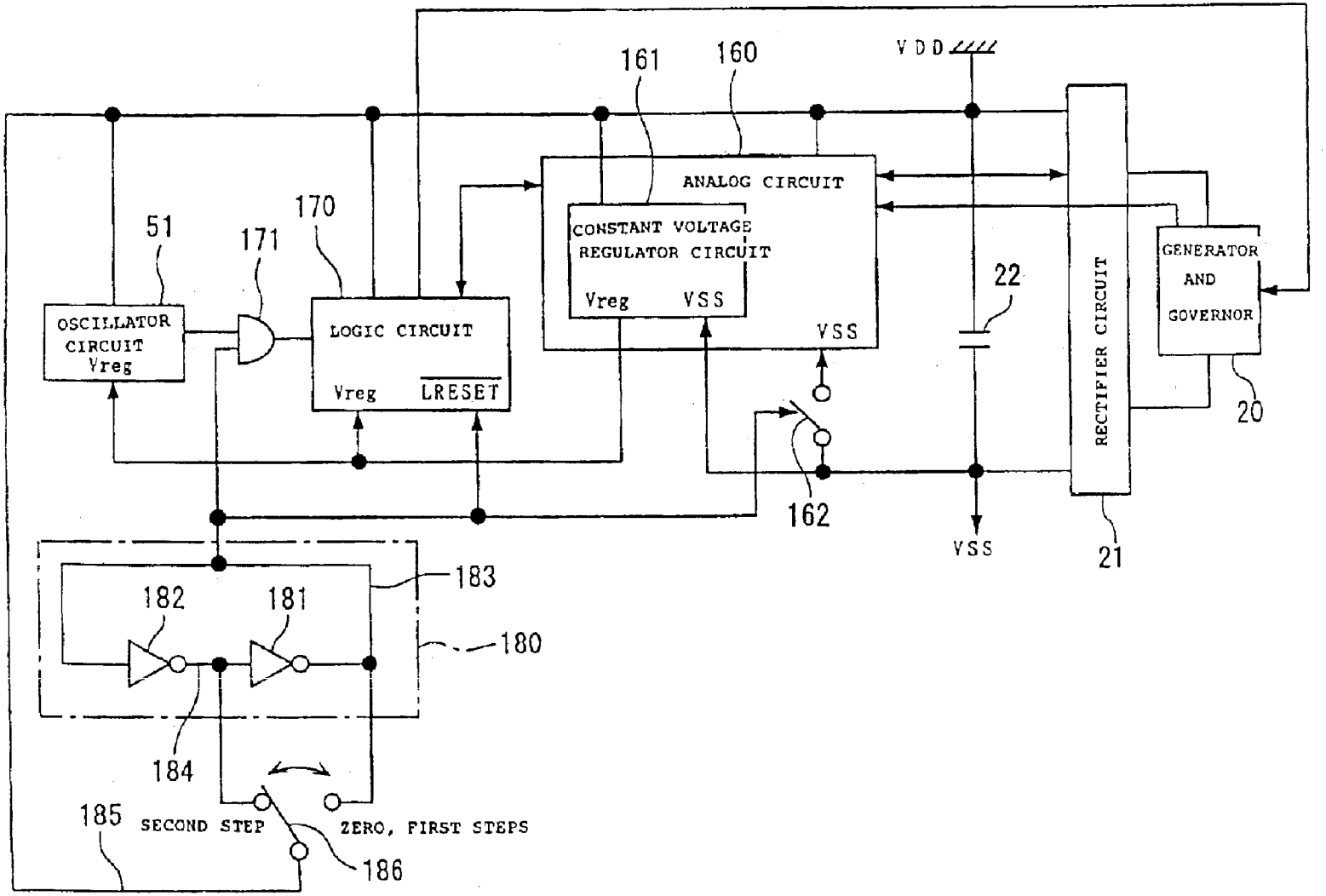
FIG. 3 is a circuit diagram of a rotation controller of the first embodiment.

The rotation controller 50 is divided into an analog circuit 160 and a logic circuit 170 according to types as shown in FIG. 3. The analog circuit 160 is driven by a power source VSS, and specifically includes part of the rotation detector circuit 53 that acquires information about the rotational status of the rotor from the generator 20 and the rectifier circuit 21, and a circuit for controlling the rectifier circuit 21. The information about the rotational status of the rotor, acquired by the rotation detector circuit 53, is transferred to the logic circuit 170.

The analog circuit 160 includes a constant voltage regulator 161 which is a power supply circuit for the logic circuit. The constant voltage regulator 161 is driven by the power source VSS, and outputs a constant voltage Vreg that is lower than the power source VSS. The constant voltage regulator 161 works as a power source for driving all circuits (the oscillator circuit 51 and the logic circuit 170) other than the rectifier circuit 21 and the analog circuit 160.

The logic circuit 170 includes a frequency divider and a variety of control circuits, and also includes the control circuit 56 that acquires information about the rotational status of the rotor, chiefly, from the analog circuit 160 to govern and control the generator 20 to rotate the rotor at a constant speed.

Each of the rotation detector circuit 53 and the control circuit 56 includes the analog circuit 160 and the logic circuit 170.

The electronically controlled timepiece further includes an crown detector circuit 180, which is an external control member detector circuit for detecting the pulled position of the crown, which is an external control member for switching between the normal mode and the hand setting mode. In the electronically controlled timepiece, the mainspring is ready to be tightened when the crown is turned. The crown is pulled in three steps, i.e., a zero step, a first step, and a second step. With the crown in the zero step, the timepiece is in a normal generating and hand driving state. With the crown in the first step, the timepiece is in a normal generating and hand driving state with the calendar ready to be corrected. With the crown in the third step, the rotor stops rotation with neither hand driving nor power generation carried out.

The crown detector circuit 180 includes a first signal line 183 for connecting the output of a first inverter 181 to the input of a second inverter 182, a second signal line 184 for connecting the output of the second inverter 182 to the input of the first inverter 181, and a selection switch 186 which connects the second signal line 184 to a signal input line 185 of the crown that is connected to the power source VDD when the crown is in the hand setting mode (in the second step), and which connects the first signal line 183 to the signal input line 185 when the crown is at another mode (in the zero step or the first step) other than the hand setting mode.

The first signal line 183 of the crown detector circuit 180 is connected to a power cutoff switch 162, which is a switch for cutting off the supply of electrical energy to the analog circuit 160, and a clock cutoff gate 171, which is clock input limiting means for cutting off the clock input to the logic circuit 170 from the oscillator circuit 51. The first signal line 183 is further connected to a reset terminal of the logic circuit 170. With a low-level signal input at the reset terminal, the internal status of the logic circuit 170 is reset to the initial state thereof.

The power cutoff switch 162 remains on while the crown detector circuit 180 provides a high-level output, and remains off while the crown detector circuit 180 provides a low-level output. The clock cutoff gate 171 is composed of an AND gate, and directly feeds a clock signal from the oscillator circuit 51 to the logic circuit 170 when the crown detector circuit 180 provides a high-level output, and blocks the signal from the oscillator circuit 51 when the crown detector circuit 180 provides a low-level signal.

Figure 4:
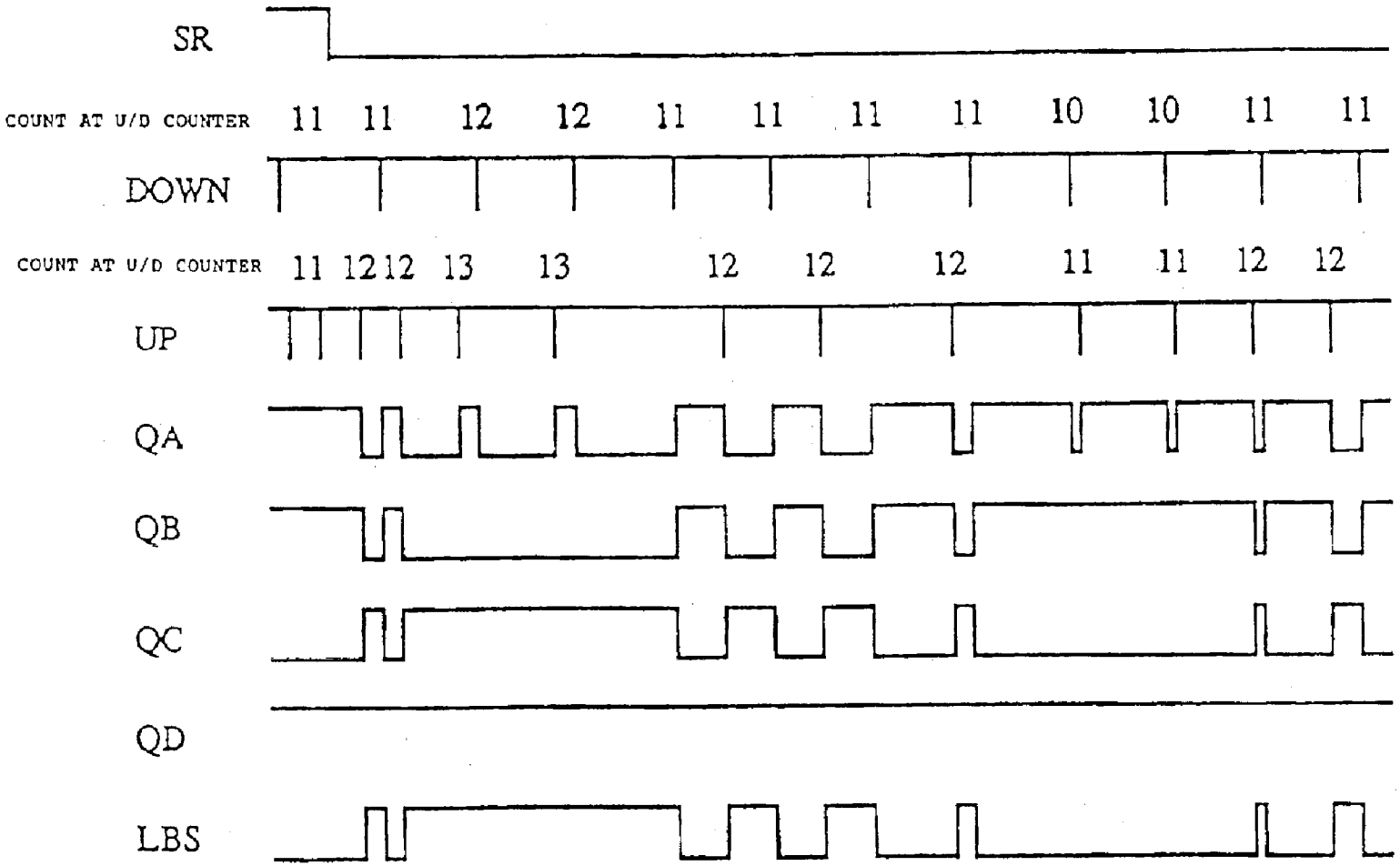
FIG. 4 is a timing chart of the circuit of the first embodiment.
Figure 5:
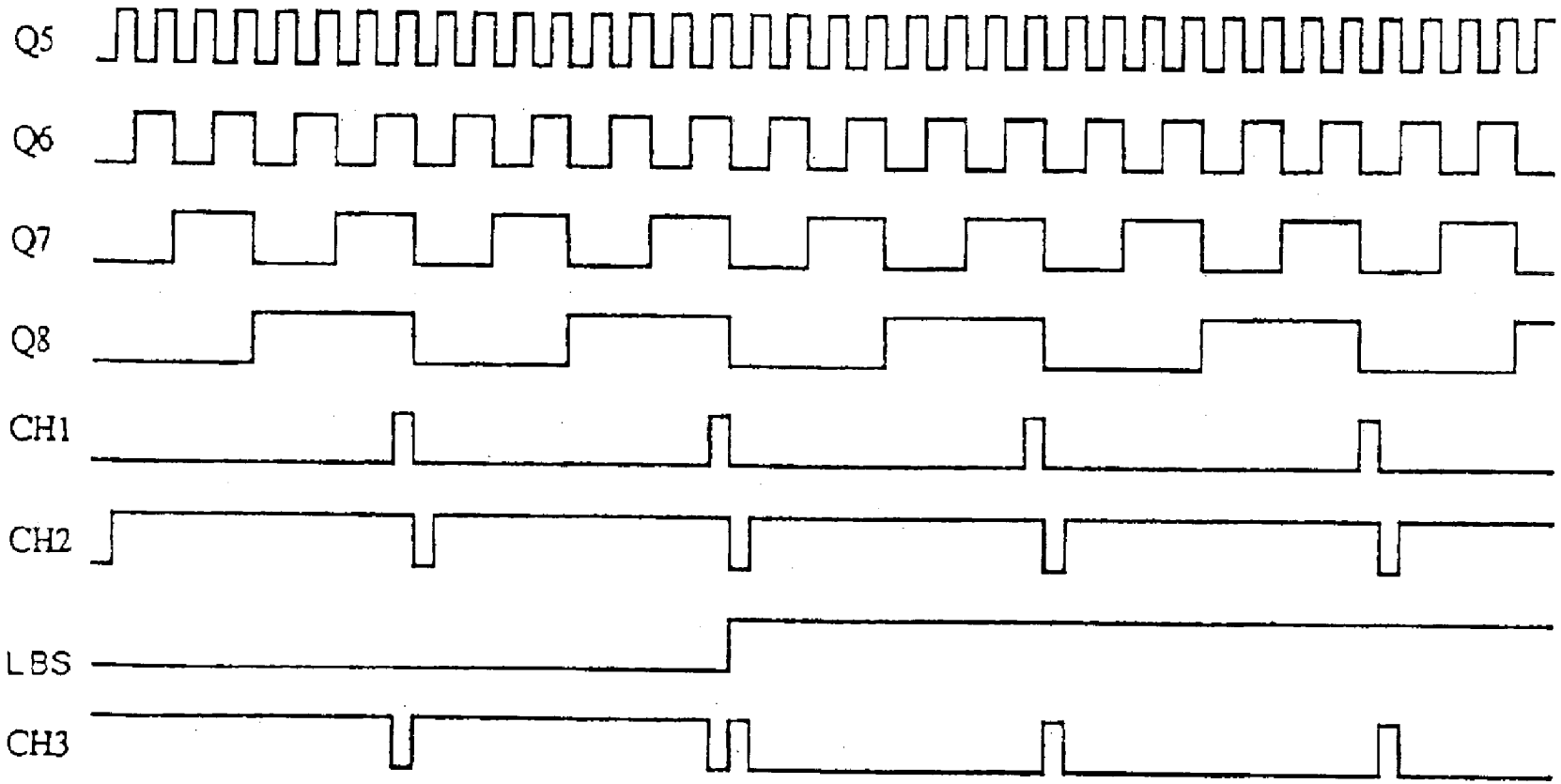
FIG. 5 is a timing chart of the circuit of the first embodiment.
Figure 6:
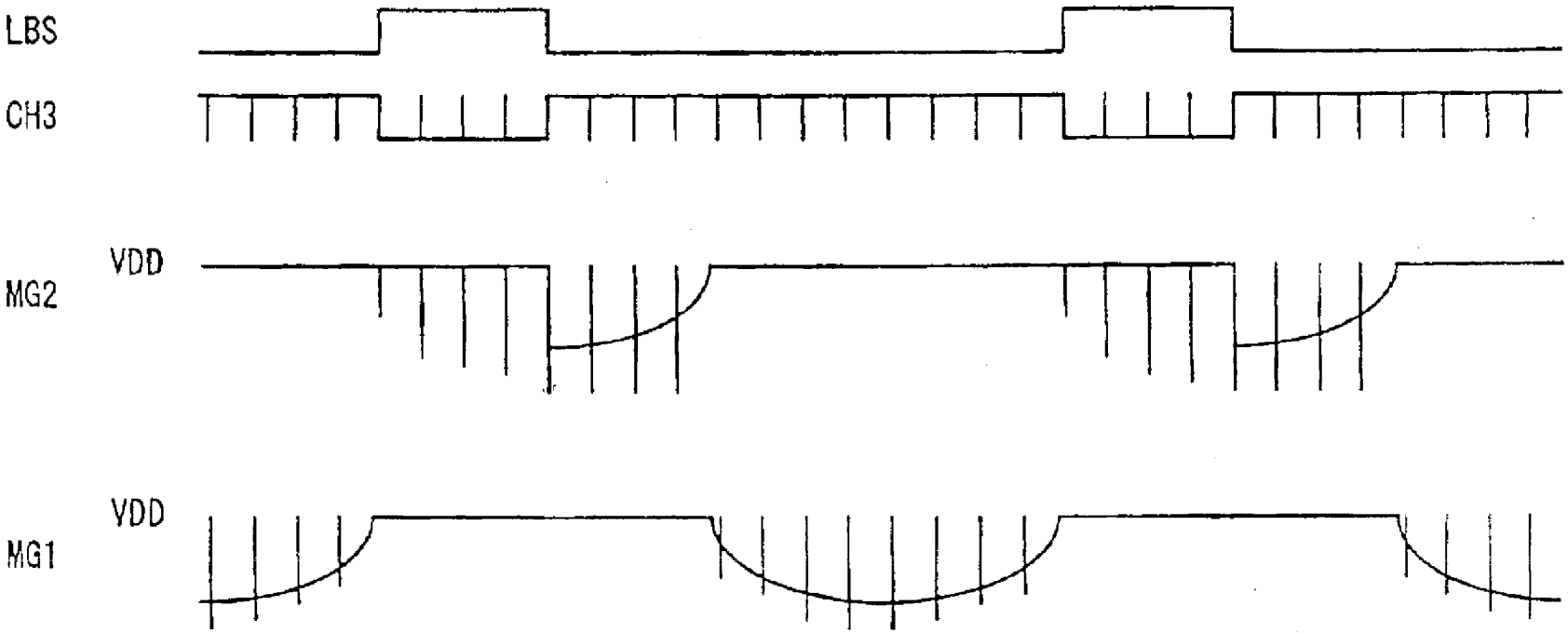
FIG. 6 is a waveform diagram showing an alternating-current output signal of a generator in the circuit of the first embodiment.
Figure 7:
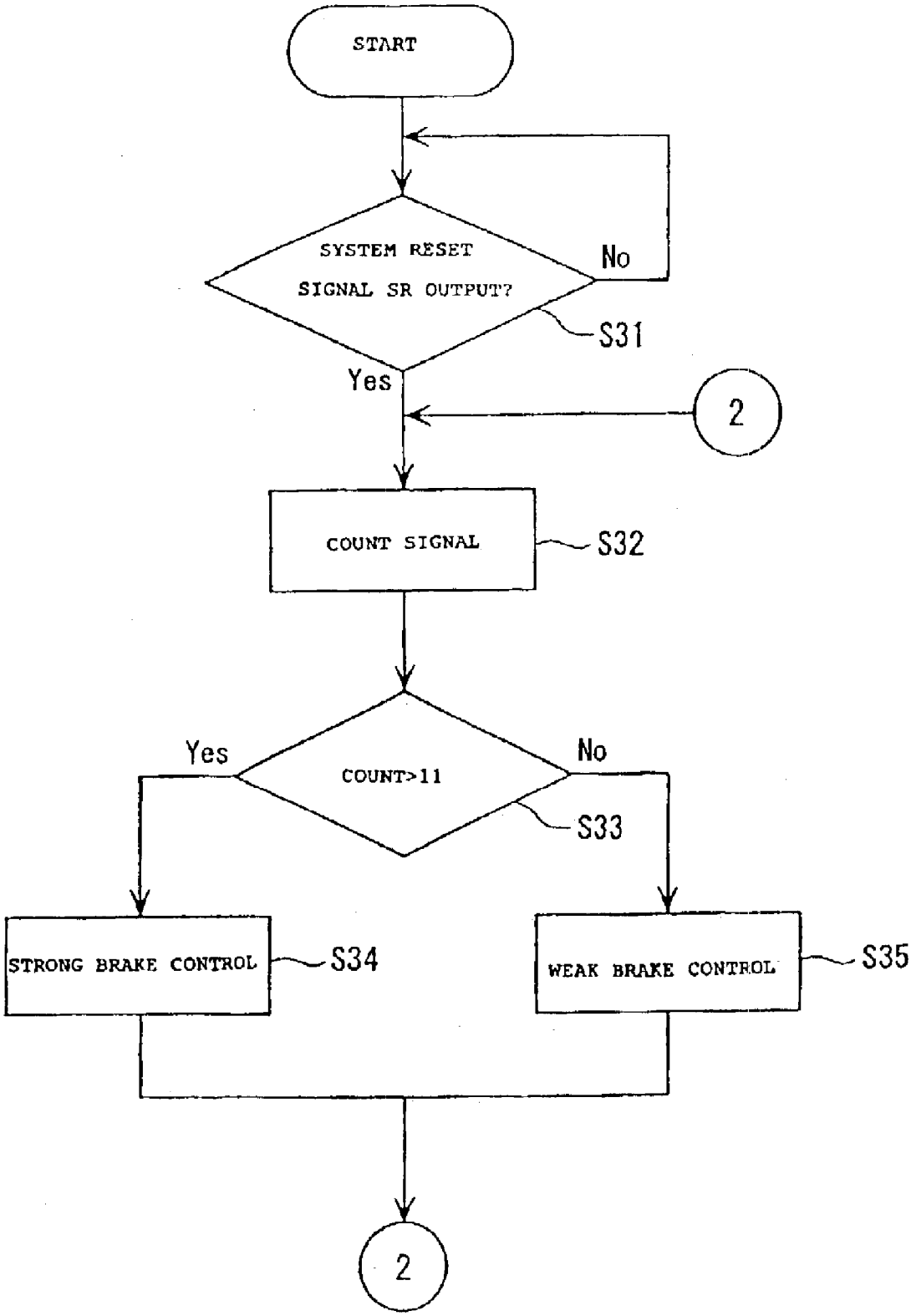
FIG. 7 is a flow chart showing a control method of the first embodiment.

The operation of the present embodiment in the hand driving mode is discussed, referring to timing charts shown in FIG. 4 through FIG. 6, and a flow chart shown in FIG. 7.

When the generator 20 starts operating, causing the initializing circuit 91 to output a low-level system reset signal SR to the load input of the up/down counter 54 (Step 31, hereinafter simply referred to S rather than Step), the up count input signal based on the rotation signal FG1 and the down count input signal based on the reference signal fs are counted by the up/down counter 54 as shown in FIG. 4 (S32). These signals are adjusted through the synchronization circuit 70 so that they are not concurrently input to the up/down counter 54.

When the up count input signal is input with the initial count of "11", the count is shifted to "12". The output LBS is driven high, and is output to the AND gate 88 in the chopping signal generator 80.

When the down count, input signal is input, causing the count to return to "11", the output LBS is driven low.

In the chopping signal generator 80, the first chopping signal generating means 81 gives the output CH1 and the second chopping signal generating means 85 gives the output CH2, based on the outputs Q5–Q8 of the frequency divider 52, as shown in FIG. 5.

When the up/down counter 54 outputs a low-level output LBS (with the count at "11" or lower), the output of the AND gate 88 is also at a low level. The output CH3 of the NOR gate 89 is a chopping signal, which is an inverted CH1, having a duty factor (the ratio of turn on time of the switch 121) of a long high-level duration (brake off time) and a short low-level duration (brake on time). The brake on time of the reference period becomes short, and practically, no brake is applied to the generator 20. Specifically, the weak brake control with a priority placed on power generation is performed (S33 and S35).

When the up/down counter 54 outputs a high-level output LBS (with the count at "12" or higher), the output of the AND gate 88 is also at a high level. The output CH3 of the NOR gate 89 is a chopping signal, which is an inverted CH2, having a duty factor of a long low-level duration (brake on time) and a short high-level duration (brake off time). The brake on time of the reference period becomes long, and strong brake control is performed to the generator 20. However, the brake off is repeated at regular intervals, permitting the chopper control, in which a reduction in generated power is controlled while braking torque is increased (S33 and S34).

The step-up and rectifier circuit 21 stores charge generated by the generator 20 into the capacitor 22. Specifically, the polarity of a first alternating-current terminal MG1 is "−" while the polarity of a second alternating-current terminal MG2 is "+", and the voltage induced at the generator 20 charges a capacitor 123 having a capacitance of 0.1 $\mu$F, for instance.

On the other hand, the polarity of the first alternating-current terminal MG1 becomes "+" while the polarity of the second alternating-current terminal MG2 becomes "−", and the sum of the voltage induced at the generator 20 and the charge voltage at the capacitor 123 charges the capacitor 22.

At each of the above states, the generator 20 are shorted and then opened between the terminals thereof by the chopping pulse, inducing a high voltage across the terminals of the coil as shown in FIG. 6. This high charge current charges the power supply circuit (capacitor) 22, thereby increasing the charging efficiency.

When the torque of the mainspring 1*a* is large enough to rotate the generator 20 at a high rotational speed, a further up count input signal may be fed even after the up count signal raised the count to "12". In such a case, the count rises to "13", and the output LBS remains at a high level. The strong brake control is thus performed in which a brake is applied while being turned off at regular intervals by the chopping signal CH3. With a brake applied, the rotational speed of the generator 20 drops. If the reference signal fs (the down count input signal) is input twice before the entry of the rotation signal FG1, the count drops to "12", and to "11". At the moment the count drops to "11", weak brake control is selected.

In such a brake control, the generator 20 reaches a set rotational speed, and the up count input signal and the down count input signal are alternately input to the up/down counter 54, causing the count to alternate between "12" and "11" in a locked state as shown in FIG. 4. In response to the count, the strong brake control and weak brake control alternate. Specifically, in one reference period during which the rotor makes one revolution, the chopping signal having a large duty factor and the chopping signal having a small duty factor are fed to the switch 121 to perform the chopping control.

The mainspring 1*a* is unwound, outputting a smaller torque, and the brake on time is gradually shortened. The rotational speed of the generator 20 becomes close to the reference speed even with no brake applied.

With no brake applied at all, the down count input signal is more frequently input. The count drops to a value of "10" or smaller, and the torque of the mainspring 1*a* is regarded as lowered. The hand is thus motionless or left moving at a very slow speed. A buzzer may be sounded, or a light may be lit to urge the user to tighten the mainspring 1*a*.

While the up/down counter 54 outputs a high-level LBS signal, the strong brake control is performed using the chopping signal having a large duty factor. While the up/down counter 54 outputs a low-level LBS signal, the weak brake control is performed using the chopping signal having a small duty factor. Specifically, the up/down counter 54 as the brake control means switches between the strong brake control and the weak brake control.

In the embodiment, during the low-level LBS signal, the duty factor of the CH3 chopping signal is 15:1 (high-level duration: low-level duration), namely, $1/16=0.0625$. During the high-level LBS signal, the duty factor of the CH3 chopping signal is 1:15 (high-level duration: low-level duration), namely, $15/16=0.9375$.

Referring to FIG. 6, the generator 20 outputs, across MG1 and MG2, an alternating current in response to the change in magnetic flux. Depending on the output LBS signal, the chopping signals CH3 at a constant frequency but different duty factors are fed to the switch 121. When the high-level LBS signal is output, namely, during the strong brake control, the short-circuit braking time in each chopper cycle is lengthened. The amount of braking increases, reducing the rotational speed of the generator 20. As the amount of breaking increases, generated power is reduced, accordingly. However, energy accumulated during the short-circuit braking is output when the chopping signal turns off the switch 121, and is used to step up the output voltage of the generator 20. In this way, a reduction in generated power during the short-circuit braking is compensated for. The braking torque is thus increased while the reduction in generated power is restricted.

When the low-level LBS signal is output, namely, during the weak brake control, the braking time in the chopping cycle is shortened, increasing the rotational speed of the generator 20. In this case, also, the chopping signal turns the switch 121 from on to off, and chopper voltage step-up results. The generated power is large compared with the generated power with no brake applied at all.

The alternating-current output of the generator 20 is stepped up and rectified through the voltage step-up and rectifier 21, and charges the power supply circuit (capacitor) 22, which in turn drives the rotation controller 50.

The output LBS of the up/down counter 54 and the chopping signal CH3 are commonly based on the outputs Q5–Q8 and Q12 of the frequency divider 52. More specifically, the frequency of the chopping signal CH3 is an integer multiple of the frequency of the output LBS, and the change in signal level of the output LBS, namely, a switch timing between the strong brake control and the weak brake control, takes place in synchronization with the chopping signal CH3.

Control of the time correction operation (hand setting operation) is performed in this embodiment as discussed below.

Figure 8:
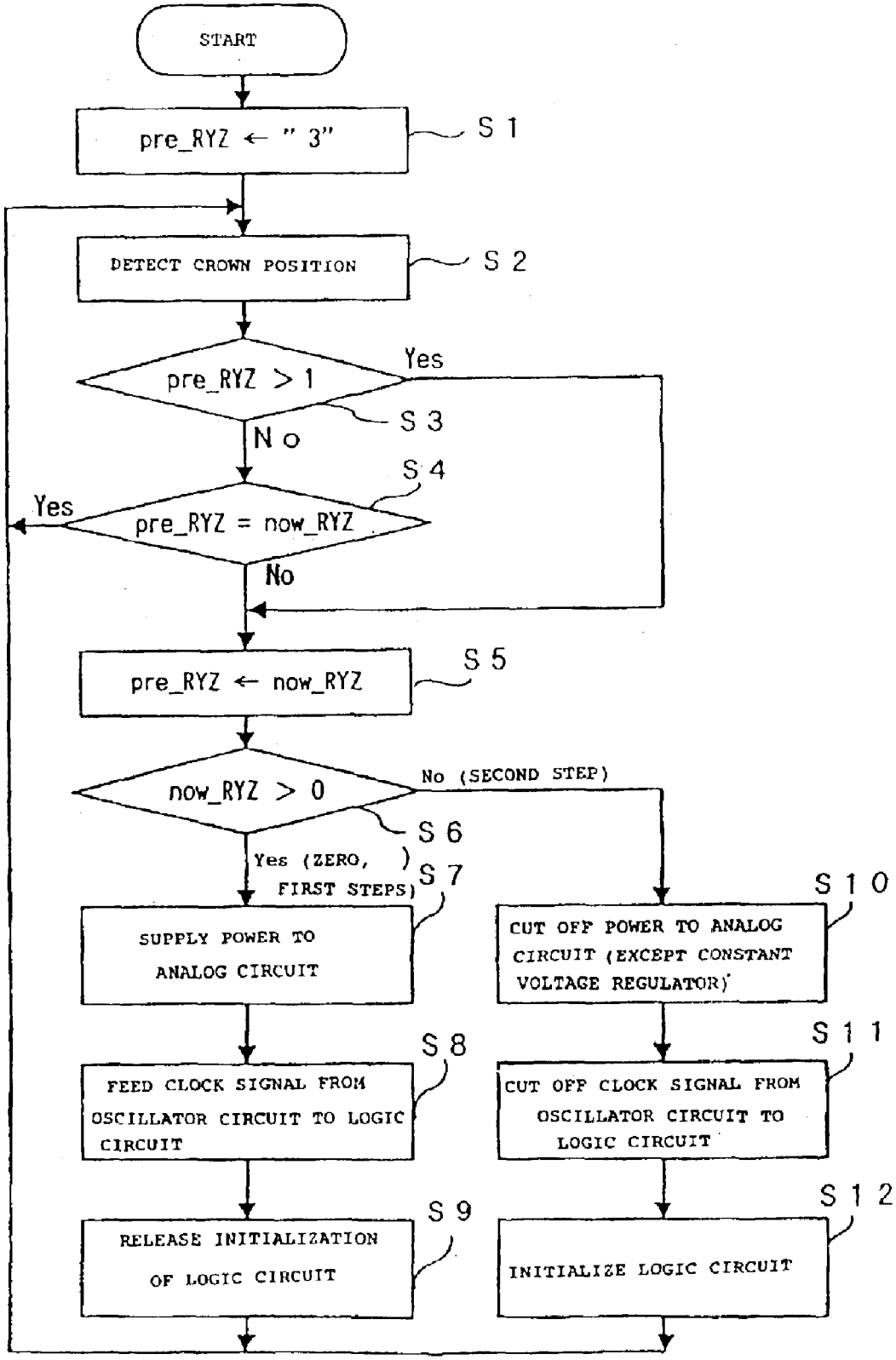
FIG. 8 is a flow chart showing a power supply control method of the first embodiment.

When the crown is pulled out from the normal hand driving position for the hand setting position, the control flow shown in FIG. 8 is performed. Specifically, a storage register "pre_RYZ" for storing preceding crown position data is initialized (the value 3 is substituted) (S1). The value input at the initialization is any value other than the values set for representing the positions of the crown. For instance, when the crown positions are represented by two values "0" and "1", 2 or larger number is acceptable. When three values "0", "1", and "2" are used, "3" or larger number may be used.

Figure 9:
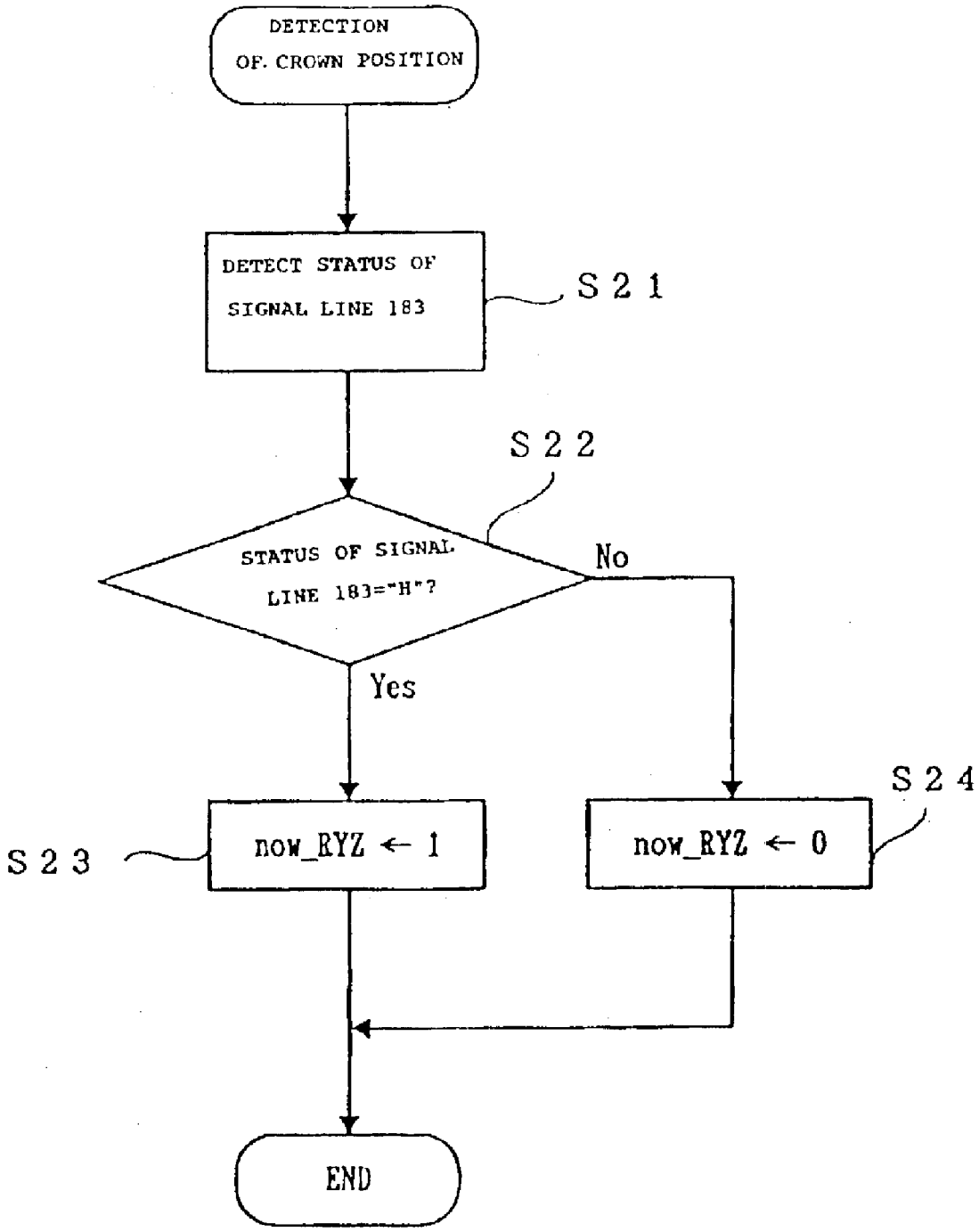
FIG. 9 is a flow chart showing a crown position detection process in the power supply control method of the first embodiment.

The crown position is detected (S2). The detection of the crown position is performed by the crown detector circuit 180 as described in the control flow shown in FIG. 9.

When the crown is placed in the zero step or the first step, the switch 186 is connected to the first signal line 183. Since the crown, namely, the switch 186 is connected to the power source VDD, a high-level signal is fed to the first signal line 183. This signal is inverted through the second inverter 182 and the first inverter 181 as in "high→low→high", and the output of the crown detector circuit 180 remains high. The status of the first signal line 183 is detected (S21), and a determination is made of whether the status is a high-level signal (S22). A high-level signal determines that the crown is placed in the zero step or in the first step, and the value "1" is entered into the storage register "now_RYZ" storing current crown position data (S23).

When the crown is placed in the second step, the switch 186 is connected to the second signal line 184. The high-level signal from the power source VDD is inverted by the first inverter 181 into a low-level signal, which becomes the output of the crown detector circuit 180. Since the low-level signal is inverted into a high-level signal by the second inverter 182, the output signal of the crown detector circuit 180 remains low. The state of the first signal line 183 is detected (S21), and a determination is made of whether the state of the first signal line 183 is a high-level signal (S22). When the signal is found to be not high, namely, low, it is determined that the crown is placed in the second step, and the value "0" is entered to the storage register "now_RYZ" for the current crown position (S24).

Since the second signal line 184 is at a low level when the switch 186 is turned, the high-level signal and the low-level signal are shorted, allowing a short-circuit current to flow and consuming energy in vain. In this embodiment, the resistances of the inverters 181 and 182 are set to be large, making the current flowing therethrough to be small, and the short-circuit current taking place as a result of the short is minimized.

When the position of the crown is detected, a determination is made of whether pre_RYZ is larger than 1 (S3). When it is found that pre_RYZ is equal to or smaller than 1 (i.e., "0" or "1" as will be discussed later), a determination is made of whether pre_RYZ is equal to now_RYZ, in other words, whether the preceding position of the crown and the current position of the crown are the same (S4). If it is found that the preceding position and the current position are the same, a power supply control process to be discussed later is not necessary, and the control flow returns to the detection process of the crown (S2).

When it is found that pre_RYZ is not equal to now_RYZ (S4), or when it is found that pre_RYZ is larger than 1, in other words, the crown is pulled out from the normal hand driving mode and remains initialized (S3), the current crown position data now_RYZ overwrites the preceding crown position data pre_RYZ (S5).

A determination is made of whether new_RYZ is larger than "0" (S6) to determine the current crown position.

When it is found that now_RYZ is larger than "0", namely, is "1", with the crown placed in the zero step or the first step, the power cutoff switch 162 is turned on, causing power from the power source VSS to be supplied to the analog circuit 160 (S7). The clock signal from the oscillator circuit 51 is directly fed to the logic circuit 170 (S8). The normal hand driving control is thus performed, and the power generation is maintained. If the logic circuit 170 remains initialized, that state is released (S9).

On the other hand, when it is found that now_RYZ is "0", i.e., the crown position is in the second step, the power cutoff switch 162 is turned off, cutting off power from the power source VSS to the analog circuit 160 (S10). The input of the clock signal from the oscillator circuit 51 to the logic circuit 170 is also cut off (S11). When the output of the crown detector circuit 180 is transitioned to an low-level signal, the internal status of the logic circuit 170 is reset, and the logic circuit 170 is initialized (S12).

However, the power supplying to the constant voltage regulator 161 is maintained, and the oscillator circuit 51 driven by the constant voltage regulator 161 remains operative.

The control flow returns to the crown position detection step (S2), and the above-discussed steps (S2 through S12) are repeated.

During the hand setting operation, a mechanical mechanism stops the rotation of the rotor, the hands are not driven and power is not generated.

When the crown is pushed to the zero step or the first step subsequent to the hand setting operation, the crown detector circuit 180 outputs a high-level signal, closing the power cutoff switch 162, and thereby driving the analog circuit 160. Furthermore, the clock cutoff gate 171 conveys the clock signal from the oscillator circuit 51. The initialized logic circuit 170 performs governing control on the rotor.

This embodiment provides the following advantages.

1) During the hand setting operation with the rotor suspended and no power generated, the power cutoff switch 162, as a power source switch, suspends the supply of power to the analog circuit 160. The clock cutoff gate 171, as clock limiting means, cuts off the clock input to the logic circuit 170, completely stopping the operation of the timepiece. The power consumption of the timepiece is thus reduced.

With this arrangement, the voltage drop across the power supply circuit (capacitor) 22 is restricted, and for a duration of time for the hand setting operation (3 to 5 minutes, for instance), the oscillator circuit 51 is continuously driven. When the crown is pushed in to resume power generation subsequent to the hand setting, the rotation controller 50 becomes operative immediately after the generator 20 starts generating in succession to the finish of the hand setting, because the oscillator circuit 51 has been continuously operated without any interruption. Unlike the conventional art, no time lag takes place before the oscillator circuit 51 becomes operative. No time indication error is caused from the hand setting operation to the resumption of time measurement. An accurate hand setting operation is thus carried out.

2) Since the crown detector circuit 180, namely, an external control member detector circuit, is a logic circuit composed of the inverters 181 and 182, the power consumption therethrough is reduced. The overall power consumption is made even smaller. Time before a voltage reduction takes place across the power supply circuit (capacitor) 22 is prolonged. The duration of time allowed for the hand setting operation is thus accordingly prolonged.

3) Since the resistances of the inverters 181 and 182 are set to be large to limit a short-circuit current, the power consumption through the crown detector circuit 180 is reduced more.

4) Since the logic circuit 170 is reset for initialization during the hand setting operation, control is usually started with the initial state when the generator 20 resumes the operation thereof subsequent to the finish of the hand setting operation. The governing control of the rotor is smoothly performed, correct control state is quickly resumed, and the creation of a time indication error is reliably prevented.

5) The rectifier circuit 21 steps up voltage through chopping, in addition to the voltage step-up through the use of the capacitor 123, the direct-current output voltage of the rectifier circuit 21, namely, the charge voltage of the capacitor 22 is thus increased.

A second embodiment of the present invention is now discussed, referring to FIG. 10 through FIG. 17. In this embodiment, components identical to those described in connection with the preceding embodiment are designated with the same reference numerals and the discussion thereabout is omitted or briefly made.

Figure 10:
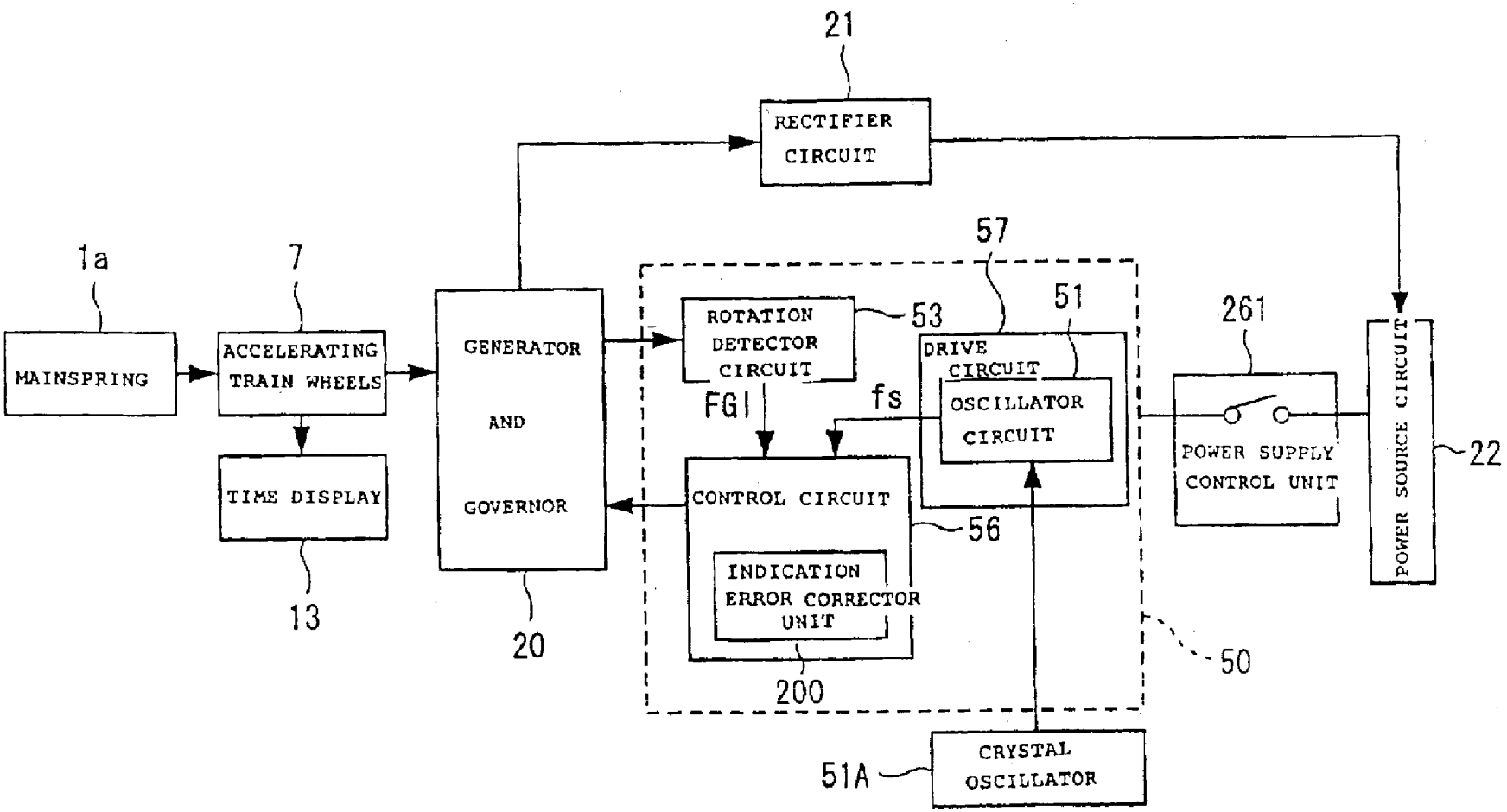
FIG. 10 is a block diagram showing the construction of an electronically controlled timepiece of a second embodiment of the present invention.

Referring to FIG. 10, the electronically controlled mechanical timepiece, which is the electronically controlled timepiece of this invention, includes a mainspring 1*a* as a mechanical energy source, accelerating train wheels (series of wheels) 7 as mechanical energy transmission means for transmitting torque of the mainspring 1*a* to a generator 20, and a hand 13, as a time display unit for indicating time, connected to the accelerating train wheels 7.

The generator 20 is driven by the mainspring 1*a* via the accelerating train wheels 7, and generates an electromotive force to supply electrical energy. The alternating-current output from the generator 20 is rectified by a rectifier circuit 21, which has at least one of the functions of step-up and rectification, full-wave rectification, half-wave rectification, and transistor rectification, and is stepped up as required. The alternating-current voltage is then fed to a power supply circuit 22 as a power source such as a capacitor to charge it.

Figure 11:
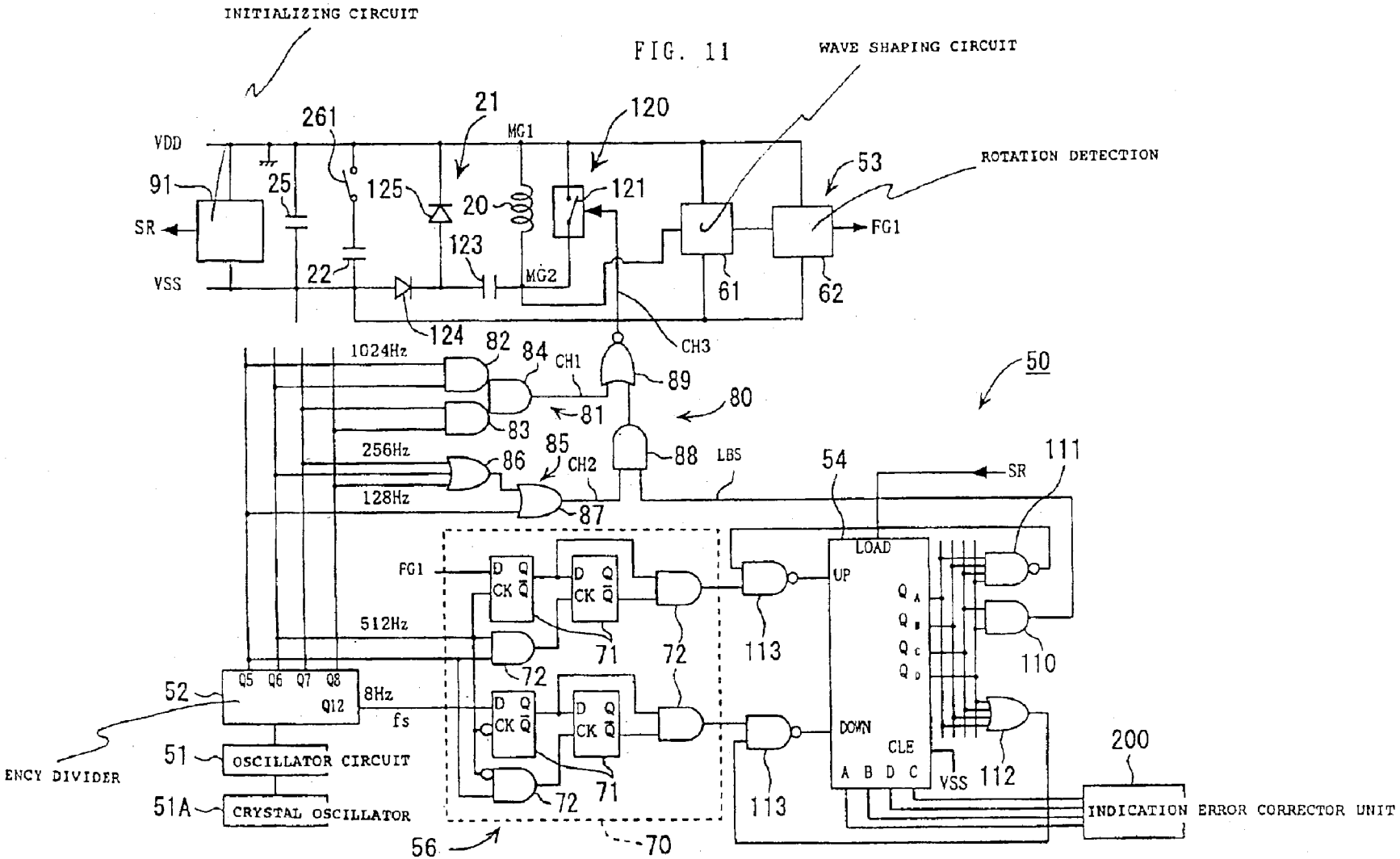
FIG. 11 is a circuit diagram showing the construction of a control circuit of the second embodiment.

The generator 20 is governed and controlled by the rotation controller 50. The rotation controller 50 includes an oscillator circuit 51, a rotor rotation detector circuit 53, and a brake control circuit 56, and the construction thereof remains unchanged from that of the first embodiment as shown in FIG. 11.

The oscillator circuit 51 generates an oscillation signal (32768 Hz) using a crystal oscillator 51A, a time standard source, and the oscillation signal is divided into a constant period through a frequency divider and is output as a reference signal fs.

The rotation detector circuit 53 is composed of a wave shaping circuit connected to the generator 20, and converts the alternating-current output from the generator 20 into a rectangular wave, and outputs as a rotation detection signal FG1 with noise removed therefrom.

The control circuit 56 compares the rotation detection signal FG1 with the reference signal fs, thereby setting the amount of braking, and applying a brake on the generator 20 to govern it.

Figure 12:
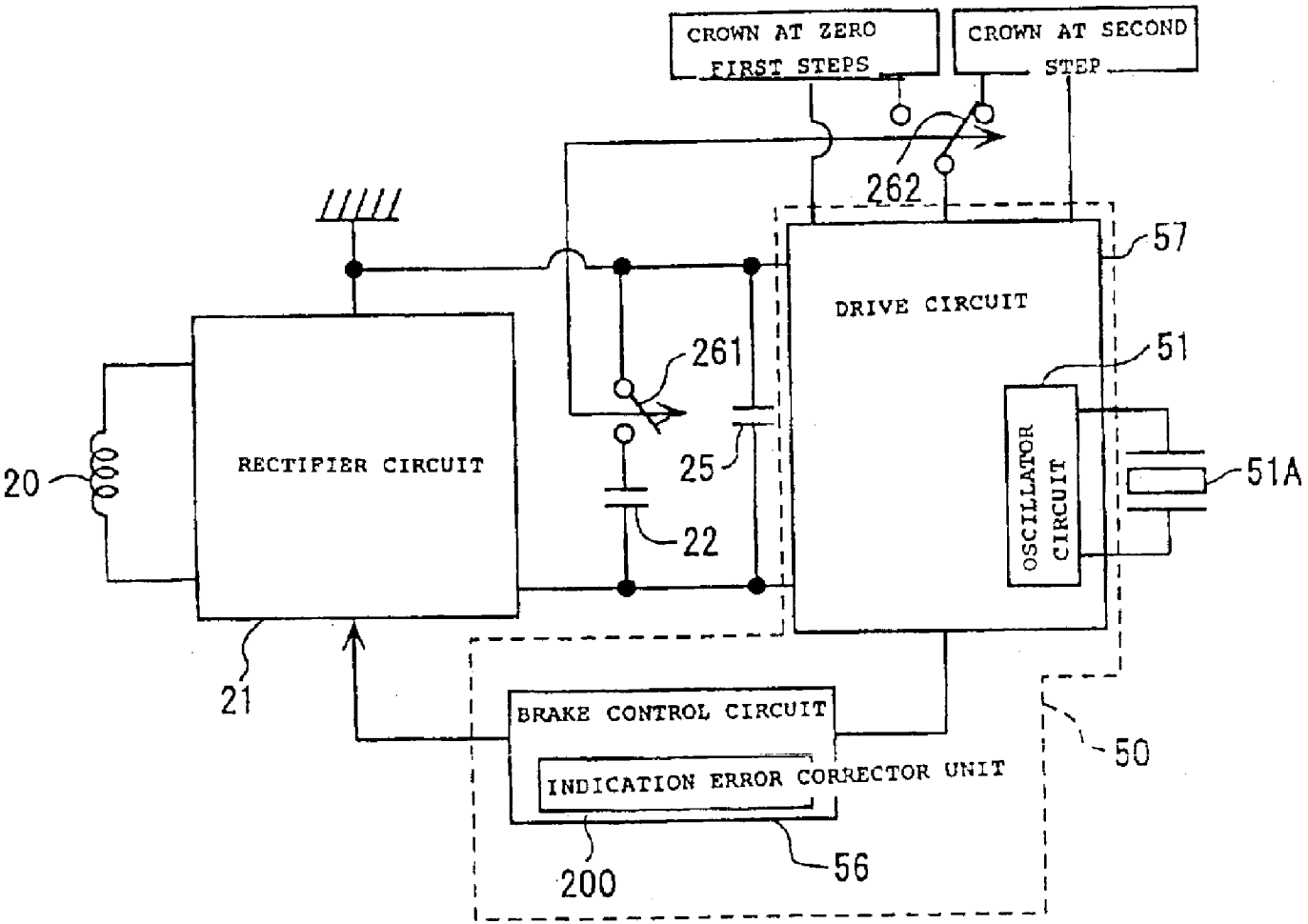
FIG. 12 is a block diagram showing a power supply control unit of the second embodiment.

Specifically, the rotation controller 50 includes a drive circuit 57 composed of a drive IC for driving the oscillator circuit 51 as shown in FIG. 12. Like the constant voltage regulator 161 in the first embodiment shown in FIG. 3, the drive circuit 57 drives the oscillator circuit 51 and the logic circuit. The drive circuit 57 is driven by power (power source VSS) from the power source capacitor 22 as the power supply circuit, and outputs a constant level voltage Vreg lower than the power source VSS. A switch 261, which is a power supply control unit, controls the supply of power from the power source capacitor 22 to the drive circuit 57.

In the electronically controlled timepiece of this embodiment, the crown can be pulled out in three steps, wherein in a zero step, the mainspring is tightened by turning the crown with the hands turning and the generator generating, and in a first step, a calendar is corrected by turning the crown with the hands turning and the generator generating, and in a second step, time correction is performed by turning the crown with the rotor stopping moving, the hands motionless, and the generator not generating. The switch 261 is closed with the crown placed in the first or zero step, and is opened with the crown placed in the second step. In other words, the switch 261 is a mechanically driven switch that operates in interlock with the time correction operation.

A switch 262 is connected to the drive circuit 57. The switch 262 is a mechanically driven switch which operates in interlock with the switch 261, and is used to input a crown position signal to the drive circuit 57. Specifically, the switch 261 is closed with the crown placed in the zero or first position, and the switch 262 is connected to a zero and first step circuit in interlock with the switch 261. With the crown placed in the second step, the switch 261 is opened, and the switch 262 is connected to a second step circuit. Recognizing the signal from these circuits, the drive circuit 57 performs timepiece control, for instance, performing normal hand driving control with the crown in the zero or first step, and setting or resetting a counter and system initialization with the crown in the second step.

A second capacitor 25, connected in parallel with the capacitor 22, is arranged between the capacitor 22 and the drive circuit 57. The second capacitor 25 is smaller in capacitance than the capacitor 22. The capacitance of the capacitor 22 falls within a range from 1 to 15 $\mu$F, and is typically 10 $\mu$F or so. The capacitance of the second capacitor 25 falls within a range from 0.05 to 0.5 $\mu$F, and is typically 0.1 $\mu$F. With the second capacitor 25 included, the supply of power to the IC (the drive circuit 57) is continuously made to prevent the IC from being shut down even if the switch 261 is momentarily disengaged due to vibrations or shocks, thereby disconnecting the first capacitor 22 from the IC.

Figure 13:
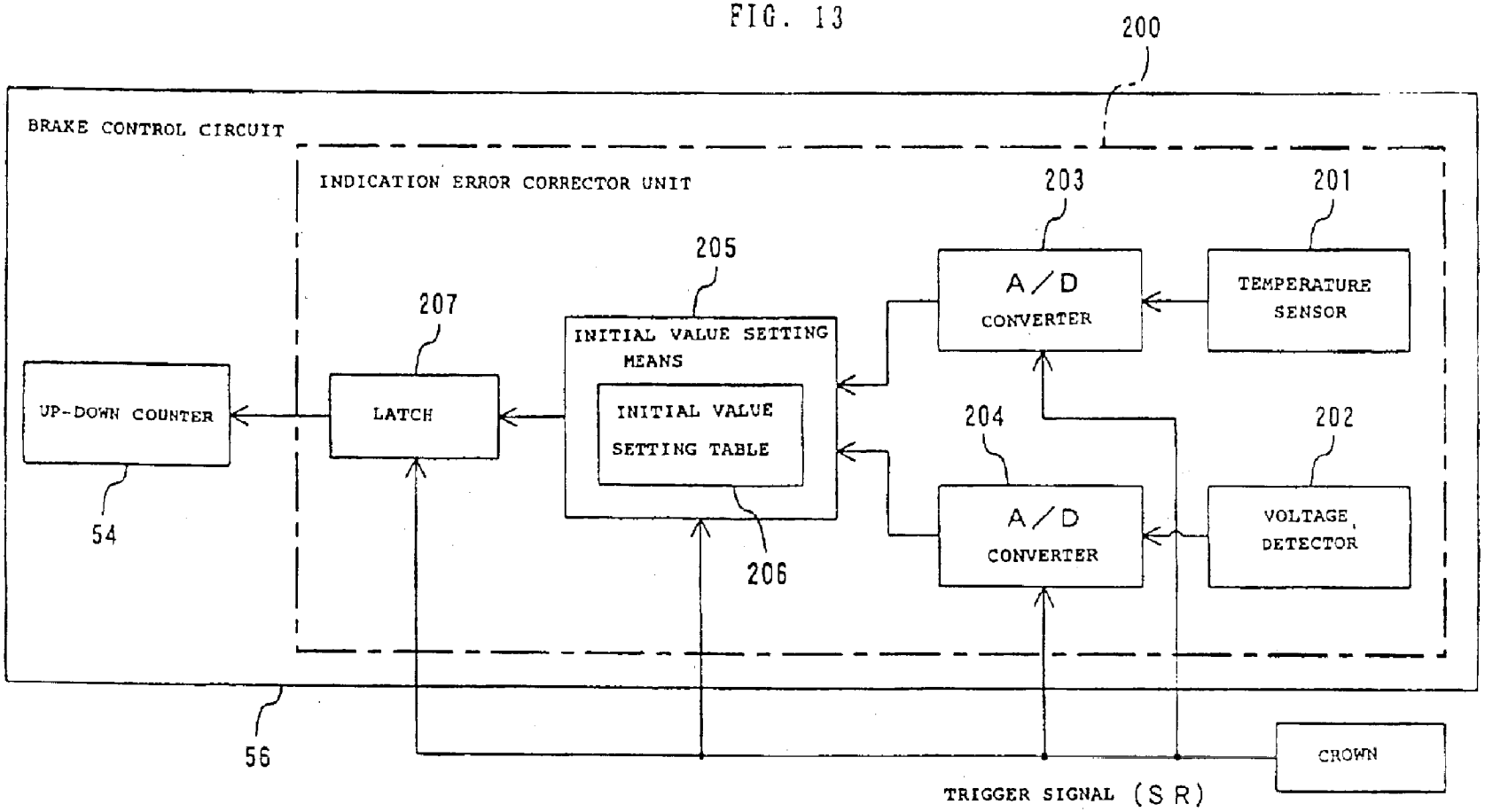
FIG. 13 is a block diagram showing an indication error corrector unit of the second embodiment.

The brake control circuit 56 includes an indication error corrector unit 200. Referring to FIG. 13, the indication error corrector unit 200 includes a temperature sensor 201, such as a water-temperature sensor or an infrared temperature sensor, a voltage detector 202, such as a comparator for detecting a voltage across the capacitor 22, A/D (analog-to-digital) converters 203 and 204 for converting measurement values provided by the temperature sensor 201 and the voltage detector 202, initial value setting means 205, which is a correction value setter for setting, for the up/down counter 54, an initial value that accounts for the output values of the converters 203 and 204, and a latch 207 that latches the data output by the initial value setting means 205.

Referring to FIG. 14, the initial value setting means 205 includes an initial value setting table 206 which sets the correspondence between the output values of the temperature sensor 201 and the voltage detector 202 (specifically, the output values of the A/D converters 203 and 204) and the initial value of the up/down counter 54. Each of the A/D converters 203 and 204 gives a 5-bit output, namely an output graduated at 32 steps within a range from zero to 32. The initial value setting table 206 divides the outputs of the A/D converters 203 and 204 at six gradations, and sets, in the up/down counter 54, an initial value corresponding to the output.

The initial value setting means 205 is connected to four data input terminals (preset terminals) A–D of the up/down counter 54 via the latch 207. The up/down counter 54 is supplied with the initial value by inputting a high-level signal or a low-level signal thereto in accordance with the initial value set by the initial value setting table 206.

The A/D converters 203 and 204, the initial value setting means 205, and the latch 207 are designed to respond to a variation in the crown position that takes place when the crown is pulled out or pushed in, namely, to a variation in a system reset signal (SR or a trigger signal).

In this embodiment, the generator 20 is controlled by the rotation controller 50 during the normal hand driving mode in the same way as in the first embodiment. Furthermore, during the normal hand driving mode, i.e., with the crown placed in the zero step or the first step, the current generated by the generator 20 charges the capacitor 22 through the rectifier circuit 21. The voltage applied to the drive circuit 57 is equal to the voltage of the capacitor 22, namely, about 1.0 V as shown in FIG. 15.

Control during the time correction operation (hand setting operation) is performed as discussed below.

Figure 15:
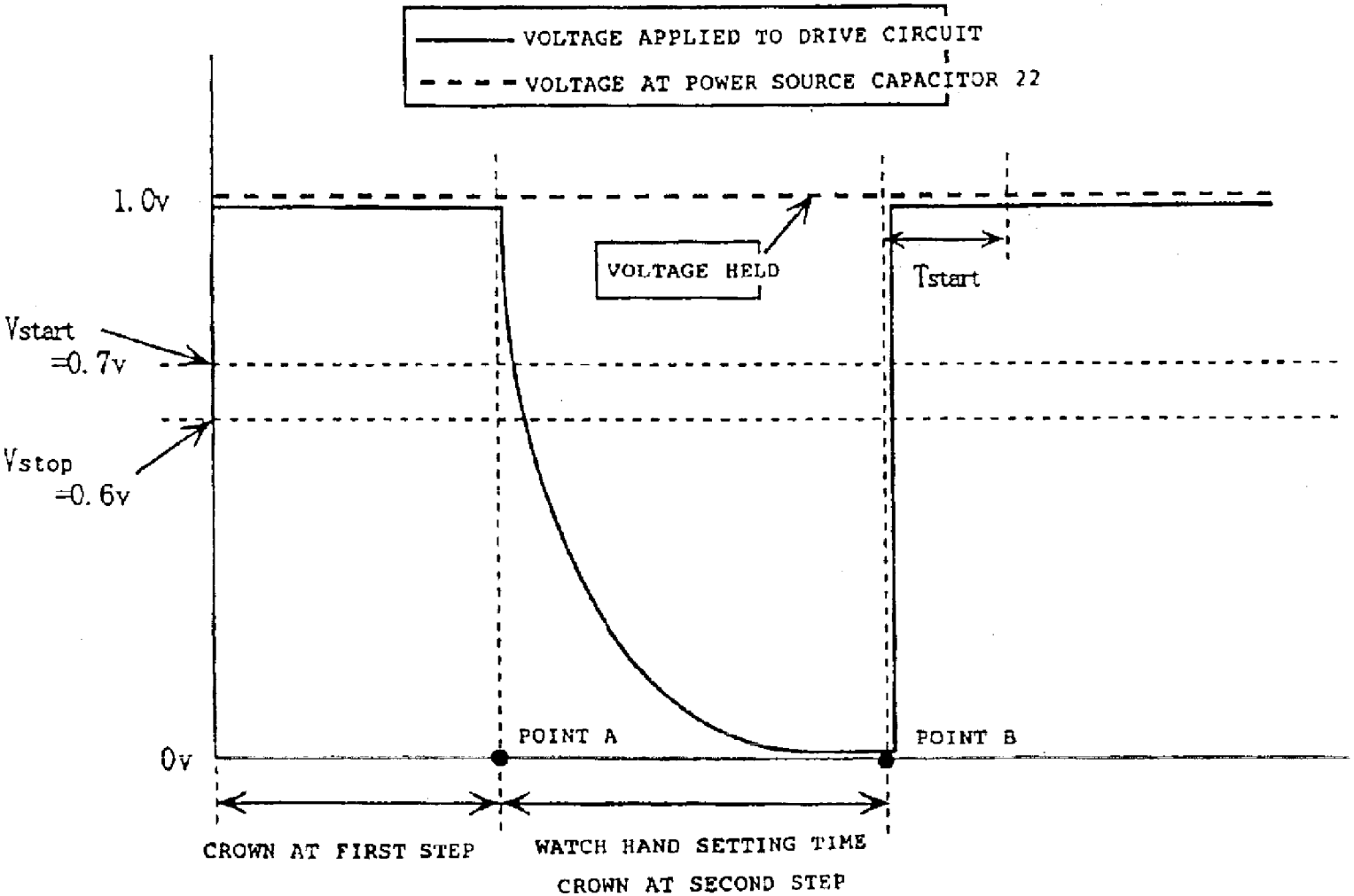
FIG. 15 is a diagram showing variations in the voltage of a capacitor and the voltage applied to a drive circuit in the second embodiment.

When the crown is pulled out to the second step from the normal hand driving position for the hand setting operation, the switch 261 is opened in interlock with the pull of the crown (point A in FIG. 15). At the same time, the generator 20 stops. Since the second capacitor 25 is used in this embodiment, power is supplied by the second capacitor 25 immediately subsequent to the stop of the generator 20. Because the capacitance of the second capacitor 25 is small, the voltage thereacross is rapidly reduced by the load of the drive circuit 57. When the voltage across the second capacitor 25, namely, the voltage applied to the drive circuit 57, drops below the voltage Vstop (approximately 0.6 V), the drive circuit 57, namely, the oscillator circuit 51 stops.

With the switch 261 opened, almost no power of the capacitor 22 is consumed, and the voltage of the capacitor 22 is maintained at a voltage of about 1.0 V.

When the crown is pushed in to the first step with the hand setting operation completed, the switch 261 is closed (point B in FIG. 15). Electrical energy is then fed to the drive circuit 57 from the capacitor 22, which has been maintained at a voltage of about 1.0 V, and the oscillator circuit 51 restarts operating.

Figure 16:
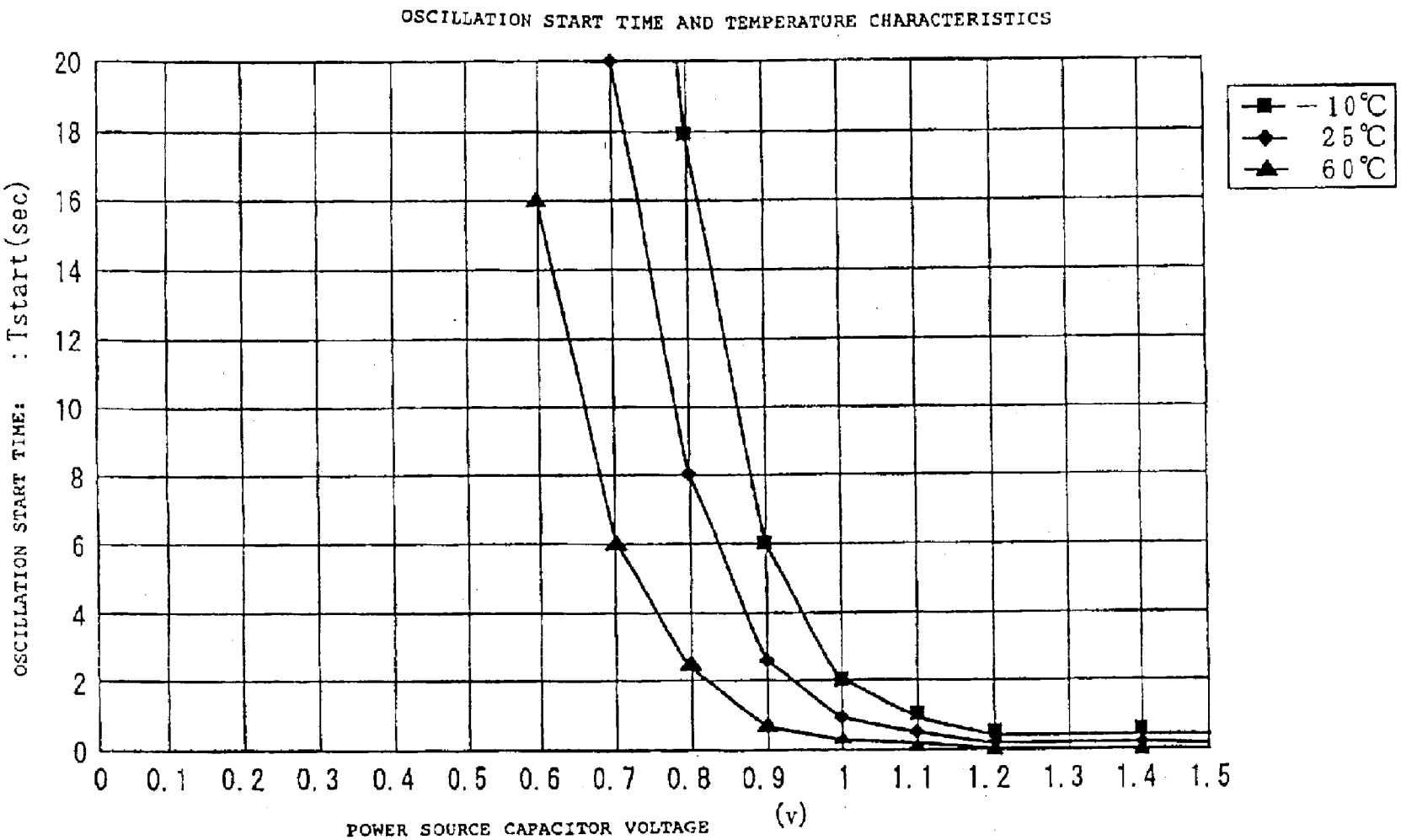
FIG. 16 is a graph showing applied voltage versus oscillation start time characteristics of an oscillator circuit with temperature as a parameter.

Since the oscillator circuit 51 is supplied with a voltage as high as 1.0 V as shown FIG. 16, time Tstart prior to the start of oscillation (corresponding to time T2 in the conventional art shown in FIG. 26) is substantially shortened to about 0.8 second (at an ambient temperature of 25° C.). Since the time T1 needed prior to the voltage rise of the capacitor 22 in the conventional art is eliminated, the time to the operation of the oscillator circuit 51 subsequent to the hand setting operation is substantially shortened.

When the oscillator circuit 51 operates, the control circuit 56 brake controls the generator 20. The initial value of the up/down counter 54 in the control circuit 56 is set by the indication error corrector unit 200.

Upon detecting the push of the crown, the A/D converters 203 and 204 in the indication error corrector unit 200 outputs, to the initial value setting means 205, values corresponding to the measurement values provided by the temperature sensor 201 and the voltage detector 202. For instance, as shown in FIG. 17, when the temperature measured by the temperature sensor 201 falls within a range equal to or higher than 0° C. and lower than 4° C., the A/D converter 203 outputs a value "10". When the temperature measured by the temperature sensor 201 falls within a range equal to or higher than 4° C. and lower than 8° C., the A/D converter 203 outputs a value "11". In this way, the output of the A/D converter 203 changes in a stepwise fashion by temperature steps of 4° C. Similarly, when the voltage measured by the voltage detector 202 falls within a range equal to or higher than 0.8 V and lower than 0.82 V, the A/D converter 204 outputs a value "10". When the voltage measured by the voltage detector 202 falls within a range equal to or higher than 0.82 V and lower than 0.84 V, the A/D converter 204 outputs a value "11". In this way, the output of the A/D converter 204 changes in a stepwise fashion by voltage steps of 0.02 V.

The initial value setting table 206 sets the initial value in accordance with the oscillation start time Tstart, namely, the output values of the converters 203 and 204. When the oscillation start time is short, the control circuit 56 is driven quickly subsequent to the time correction operation, and a correction value of "0" may be acceptable. A standard initial value ("11") may be set as the initial value of the up/down counter 54. Specifically, as shown in FIG. 16, as the voltage of the capacitor 22 is higher, and as temperature is higher, the oscillation start time becomes shorter. When the values from the converters 203 and 204 are large, an initial value of "11" is set.

When the oscillation start time is longer, more time is needed before the control circuit 56 is driven, and the time with no brake control performed on the generator 20 is prolonged. In this embodiment, the mainspring 1*a* outputs torque sufficient enough to allow the generator 20 to rotate at a speed higher than the reference period of the generator 20. With a brake applied, the generator 20 is governed to the reference period. If the time with no brake control performed is prolonged, the rotation period of the generator 20 becomes shorter than the reference period. For this reason, the longer the time to the start of the oscillation, the stronger braking is applied to reduce the rotational speed.

As in the first embodiment, strong brake control is performed with the output of the up/down counter 54 at "12" or larger, and weak brake control is performed with the output of the up/down counter 54 at "11" or smaller. By setting a large initial value to the up/down counter 54 ("15" at maximum), the time of the strong brake control is prolonged. As the voltage of the capacitor 22 is lower and as temperature is lower, the oscillation start time becomes longer. Therefore, as the output values of the converters 203 and 204 become smaller, the initial values set become larger to "11", "12", "13", "14", and then to "15".

Correction responsive to the time to the start of the oscillation of the oscillator circuit 51 is performed during the brake control by the control circuit 56. As a result, the position of the hand is corrected to no slow nor fast time state (with zero indication error), and the indication error is eliminated.

When the generator 20 starts, reverting back to the normal operation, power from the generator 20 is fed to the drive circuit 57 through the capacitor 22, and the generator 20 is continuously subjected to rotation control.

This embodiment provides the following advantages.

(2-1) Since the timepiece includes the power supply control unit which is composed of the switch 261 and is opened and closed in response to the push and pull of the crown, namely, the time correction operation, no power is supplied to the rotation controller 50 from the capacitor (power supply circuit) 22 during the suspension of the generator 20 with the crown pulled out, and the capacitor 22 maintains the terminal voltage thereacross.

The capacitor 22 thus supplies power to the rotation controller 50 immediately subsequent to the start of the generator 20 after the time correction operation. There occurs no time lag (time T1) until the voltage of the power source for the drive circuit (drive IC) 57 rises to be high enough to start oscillating, and the duration of time during which the rotation control of the rotor is not performed is shortened, and the hand indication error is thus minimized.

(2-2) Since the switch 261 disconnects the capacitor 22 from the drive circuit 57, the voltage across the capacitor 22 is maintained at a relatively high level (about 1.0 V, for instance). With this arrangement, the drive circuit 57 is supplied with a high voltage when the switch 261 is closed. The time (Tstart) until the oscillation of the oscillator circuit 51 in the rotation controller 50 is thus shortened. The rotation controller 50 becomes operative more rapidly, reducing the indication error.

(2-3) Since the timepiece includes the control circuit 56 having the indication error corrector unit 200, an indication error, if any, is corrected, and the indication error is reduced more, or almost removed.

(2-4) The indication error corrector unit 200 detects the voltage applied to the capacitor 22, namely, the oscillator circuit 51, and the temperature of the oscillator circuit 51, both affecting the oscillation start time of the oscillator circuit 51, to set the correction value (the initial value at the up/down counter 54). The correction is thus precisely performed, and the indication error is substantially minimized. Since the indication error is corrected by detecting not only the voltage applied to the oscillator circuit 51 but also temperature thereof to adjust the correction values, the accuracy level of the correction values is improved, and the indication error is further corrected. The indication error is minimized, particularly when the timepiece is used in cold areas with the temperature of the oscillator circuit 51 low, or when the timepiece is exposed to sunlight or is used in hot areas with the temperature of the oscillator circuit 51 high.

(2-5) The indication error corrector unit 200 corrects the indication error by simply changing the initial value at the up/down counter 54. Compared with the arrangement in which the correction is made by adding a correction value to the output value of the up/down counter 54, the indication error is corrected using a simple arrangement, and costs involved are reduced.

(2-6) The switch 261, namely, the power supply control unit, is a mechanically driven switch that operates in interlock with the pull operation of the crown. The switch 261 thus has a simple construction, and the electronically controlled mechanical timepiece is manufactured at low costs. It is sufficient if the switch 261 is merely added. An increase in the manufacturing cost is minimal, and the timepiece is supplied for a relatively low cost, compared with the conventional art.

(2-7) The second low-capacitance capacitor 25 is arranged, besides the capacitor 22. Even when the switch 261 suffers from chattering, the capacitor 25 feeds power to the drive circuit 57, and the drive circuit 57 is prevented from being shut down as a result of chattering.

(2-8) Since an excessively large capacitance is not required of the capacitor 22, the capacitor 22 is charged with the voltage thereof rapidly increasing from a state of no charge stored, within a short time.

Since a large generation capacity is not required of the generator 20, the sizes of the generator 20 and the mainspring 1*a* are made compact. This arrangement finds application in wristwatches, which are subject to the limitation of area and thickness dimensions.

Next, a third embodiment of the present invention is now discussed, referring to FIG. 18 through FIG. 21. In this embodiment, components identical or similar to those described in connection with the preceding embodiments are designated with the same reference numerals and the discussion thereabout is omitted here.

Figure 18:
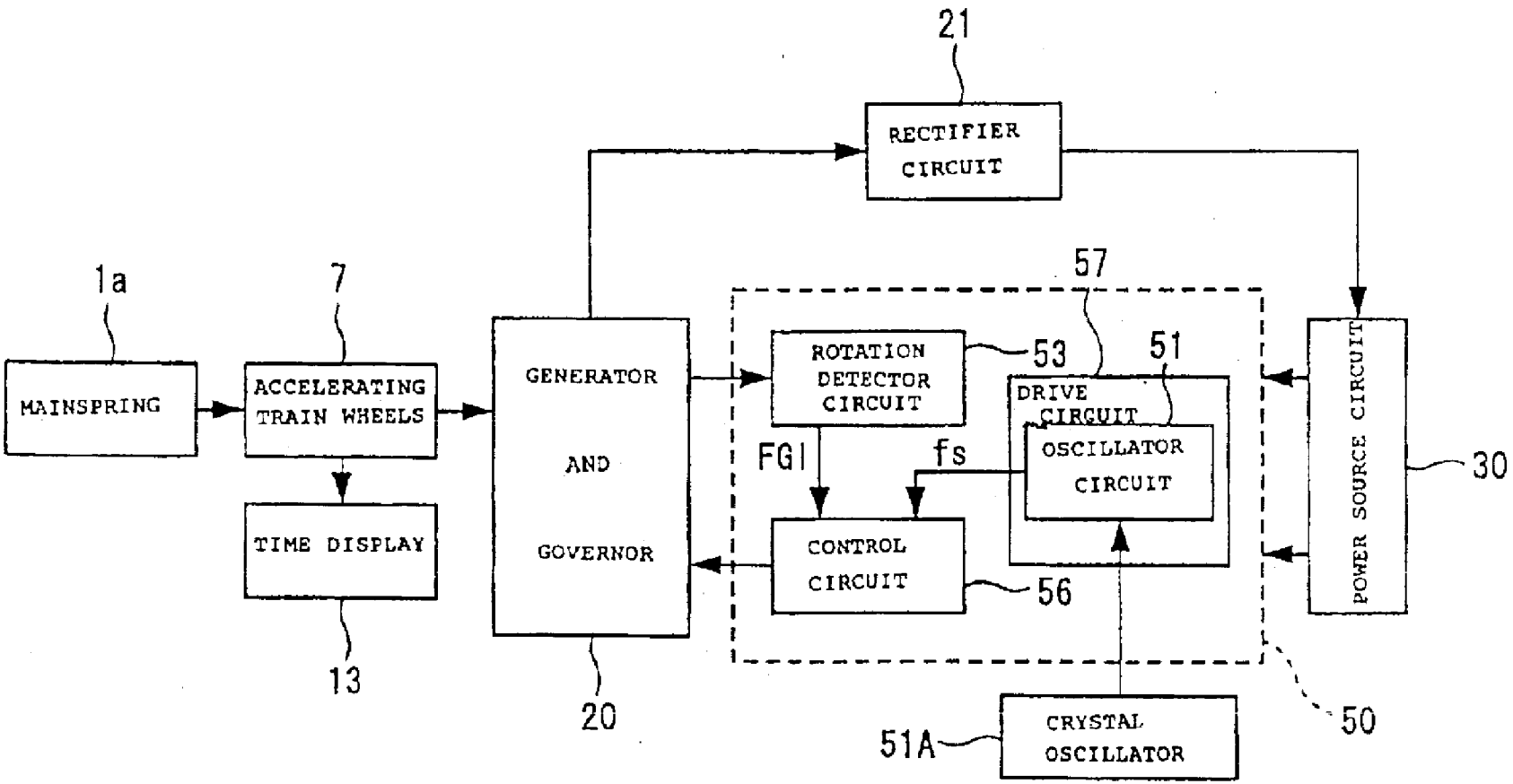
FIG. 18 is a block diagram showing the construction of an electronically controlled timepiece of a third embodiment of the present invention.

FIG. 18 is a block diagram showing an electronically controlled mechanical timepiece, which is the electronically controlled timepiece of this invention.

The electronically controlled mechanical timepiece includes a mainspring 1*a* as a mechanical energy source, accelerating train wheels (series of wheels) 7 as mechanical energy transmission means for transmitting torque of the mainspring 1*a* to a generator 20, and a hand 13, as a time display unit for indicating time, connected to the accelerating train wheels 7.

The generator 20 is driven by the mainspring 1*a* via the accelerating train wheels 7, and generates an electromotive force to supply electrical energy. The alternating-current output from the generator 20 is rectified by a rectifier circuit 21, which has at least one of the functions of step-up and rectification, full-wave rectification, half-wave rectification, and transistor rectification, and is stepped up as required. The alternating-current voltage is then fed to a power supply circuit 30 as a power source such as a capacitor to charge it.

The generator 20 is governed and controlled by the rotation controller 50. The rotation controller 50 includes an oscillator circuit 51, a rotor rotation detector circuit 53, and a brake control circuit 56, and the construction thereof remains unchanged from that of the first embodiment.

The oscillator circuit 51 generates an oscillation signal (32768 Hz) using a crystal oscillator 51A, i.e., a time standard source, and the oscillation signal is divided into a constant period through a frequency divider and is output as a reference signal fs.

The rotation detector circuit 53 is composed of a wave shaping circuit connected to the generator 20, and converts the alternating-current output from the generator 20 into a rectangular wave, and outputs as a rotation detection signal FG1 with noise removed therefrom.

The control circuit 56 compares the rotation detection signal FG1 with the reference signal fs, thereby setting the amount of braking, and applying a brake on the generator 20 to govern it.

Figure 19:
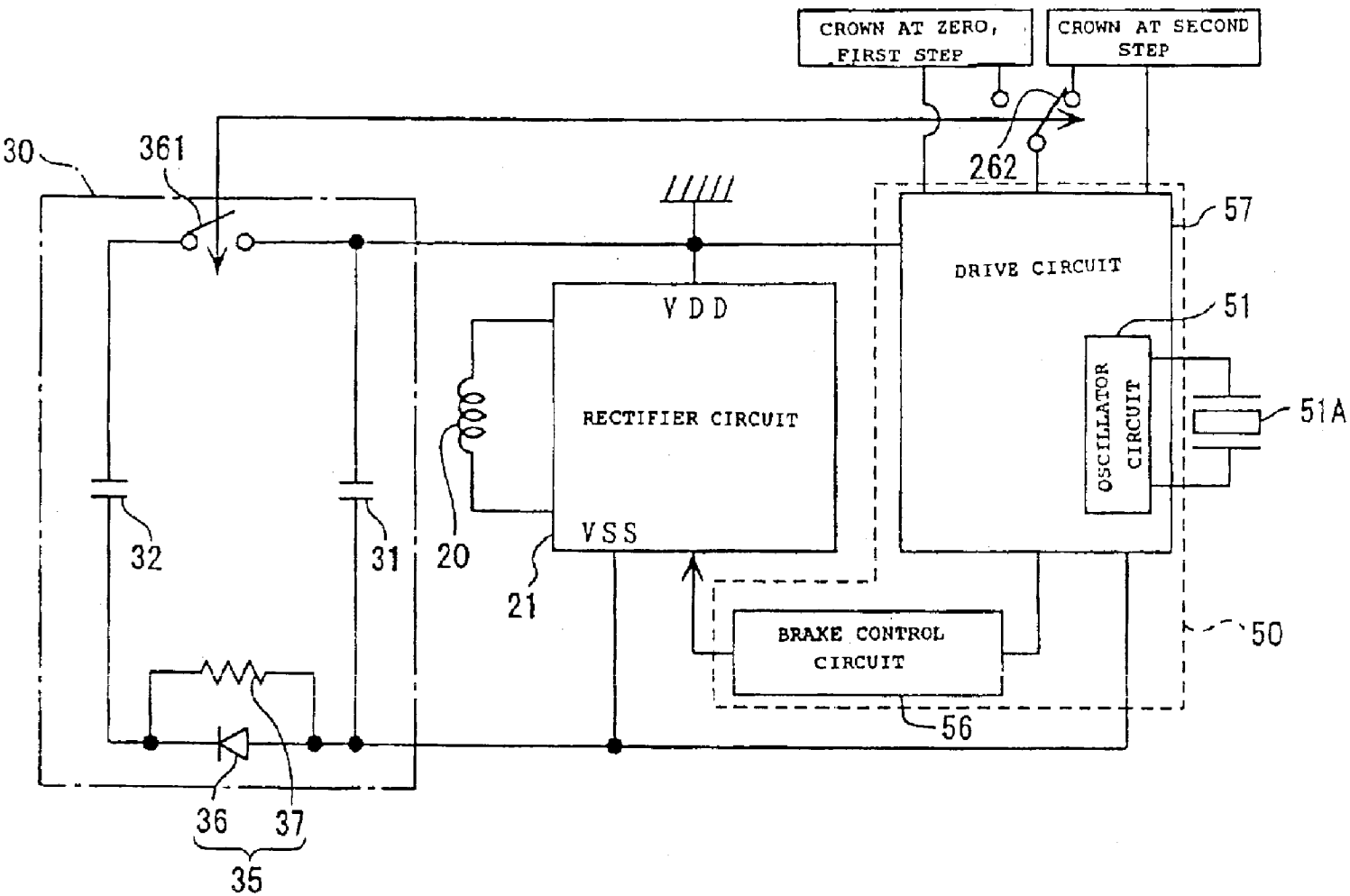
FIG. 19 is a circuit diagram showing the construction of a power supply circuit of the third embodiment of the present invention.

Specifically, the rotation controller 50 includes a drive circuit 57 composed of a drive IC for driving the oscillator circuit 51 as shown in FIG. 19. The drive circuit 57 is driven by power from a main capacitor 31 (a main storage unit) forming the power supply circuit 30. The main capacitor 31 ranges from 0.05 to 0.5 $\mu$F in capacitance, and is typically a ceramic capacitor having a capacitance of about 0.2 $\mu$F. The main capacitor 31 smoothes the current from the generator 20 to feed power to the rotation controller 50.

An auxiliary capacitor (an auxiliary storage unit) 32, having a capacitance larger than that of the capacitor 31, is connected in parallel with the main capacitor 31. The auxiliary capacitor 32 ranges from 1 to 15 $\mu$F in capacitance, and typically has a capacitance of about 10 $\mu$F.

A mechanically driven switch 361 is arranged between the capacitors 31 and 32. In the electronically controlled mechanical timepiece of this embodiment, the crown can be pulled out in three steps, wherein in a zero step, the mainspring is tightened by turning the crown with the hands turning and the generator generating, and in a first step, a calendar is corrected by turning the crown with the hands turning and the generator generating, and in a second step, time correction is performed by turning the crown with the rotor stopping moving, the hands motionless, and the generator not generating. The switch 361 is closed with the crown placed in the first or zero step, and is opened with the crown placed in the second step. In other words, the switch 361 is a mechanically driven switch that operates in interlock with the time correction operation.

A switch 262 is connected to the drive circuit 57. The switch 262 is a mechanically drive switch that operates in interlock with the switch 361, and is used to input a crown position signal to the drive circuit 57. Specifically, the switch 361 is closed with the crown placed in the zero or first position, and the switch 262 is connected to a zero and first step circuit in interlock with the switch 361. With the crown placed in the second step, the switch 361 is opened, and the switch 262 is connected to a second step circuit. Recognizing the signal from the these circuits, the drive circuit 57 performs timepiece control, for instance, performing normal hand driving control with the crown in the zero or first step, and setting or resetting a counter and system initialization with the crown in the second step.

A charge control circuit 35, composed of a diode 36 and a resistor 37 in parallel connection, is connected between the capacitors 31 and 32. A diode having a smaller forward voltage Vf (0.2 V, for instance) is preferable for the diode 36, and a Schottky barrier diode may be used. The diode 36 is configured so that the diode 36 is aligned opposite to the direction of the charging current (from VDD to VSS) when the capacitors 31 and 32 are charged by the rectifier circuit 21, namely, by the generator 20, with the switch 361 closed, and is aligned with the direction of the current flowing from the auxiliary capacitor 32 to the main capacitor 31.

The resistance of the resistor 37 is preferably large, and is 100 MΩ in this embodiment.

The power supply circuit 30 is composed of the main capacitor 31, the auxiliary capacitor 32, the charge control circuit 35 (the diode 36 and the resistor 37), and the switch 361.

In this embodiment, the normal hand driving is controlled in the same manner as in the first embodiment. Specifically, during the normal hand driving mode, i.e., with the crown placed in the zero step or the first step, the current generated by the generator 20 charges the capacitors 31 and 32 through the rectifier circuit 21, because the switch 361 is closed. Because of its small capacitance, the capacitor 31 tends to vary in voltage due to variations in the voltage of the generator 20 and the load of the drive circuit 57. But a large-capacitance auxiliary capacitor 32 connected in parallel therewith backs up, thereby maintaining the voltage constant (approximately 1.0 V).

Figure 20:
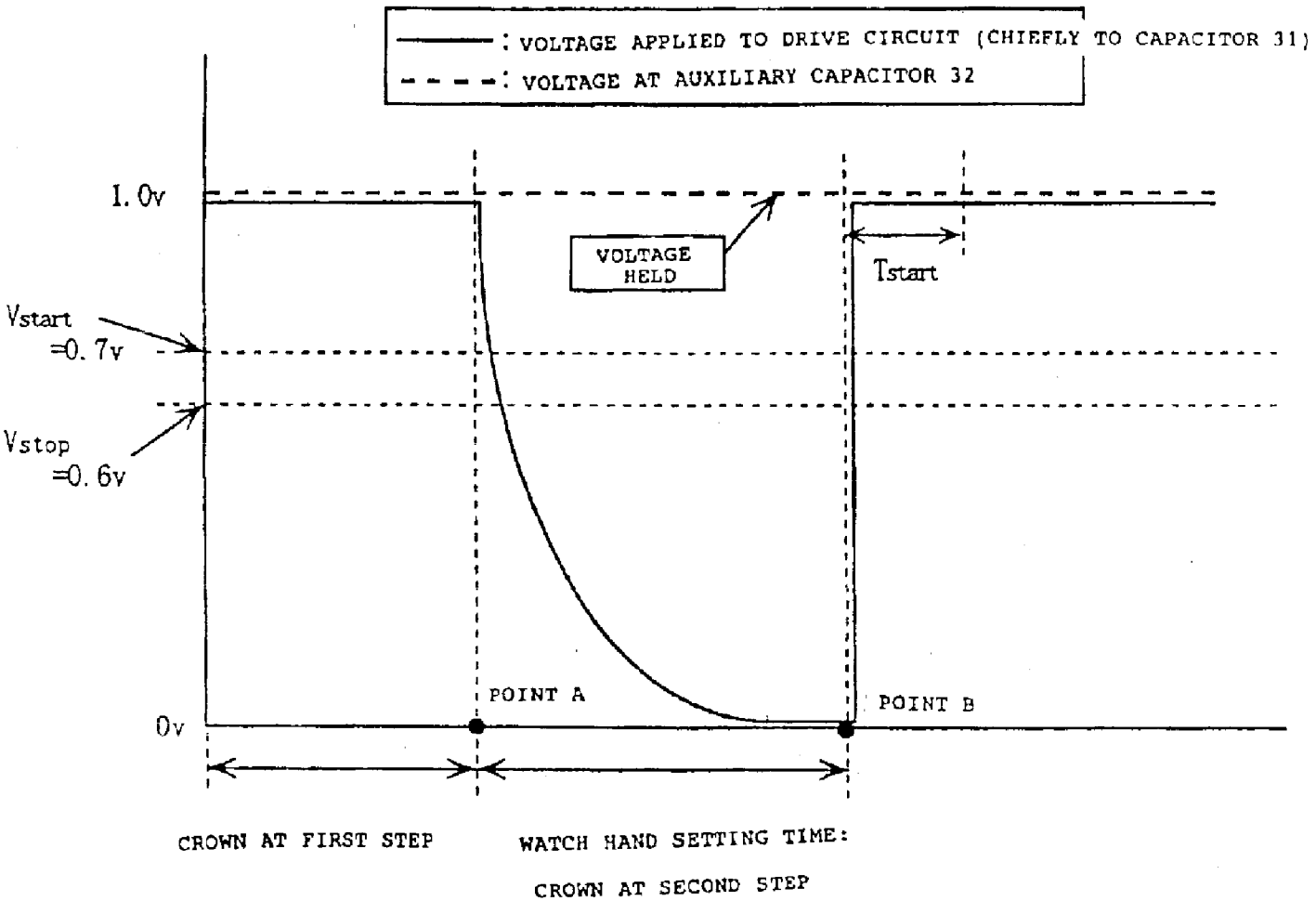
FIG. 20 is a diagram showing variations in the voltage of a capacitor and the voltage applied to a drive circuit in the third embodiment.
Figure 21:
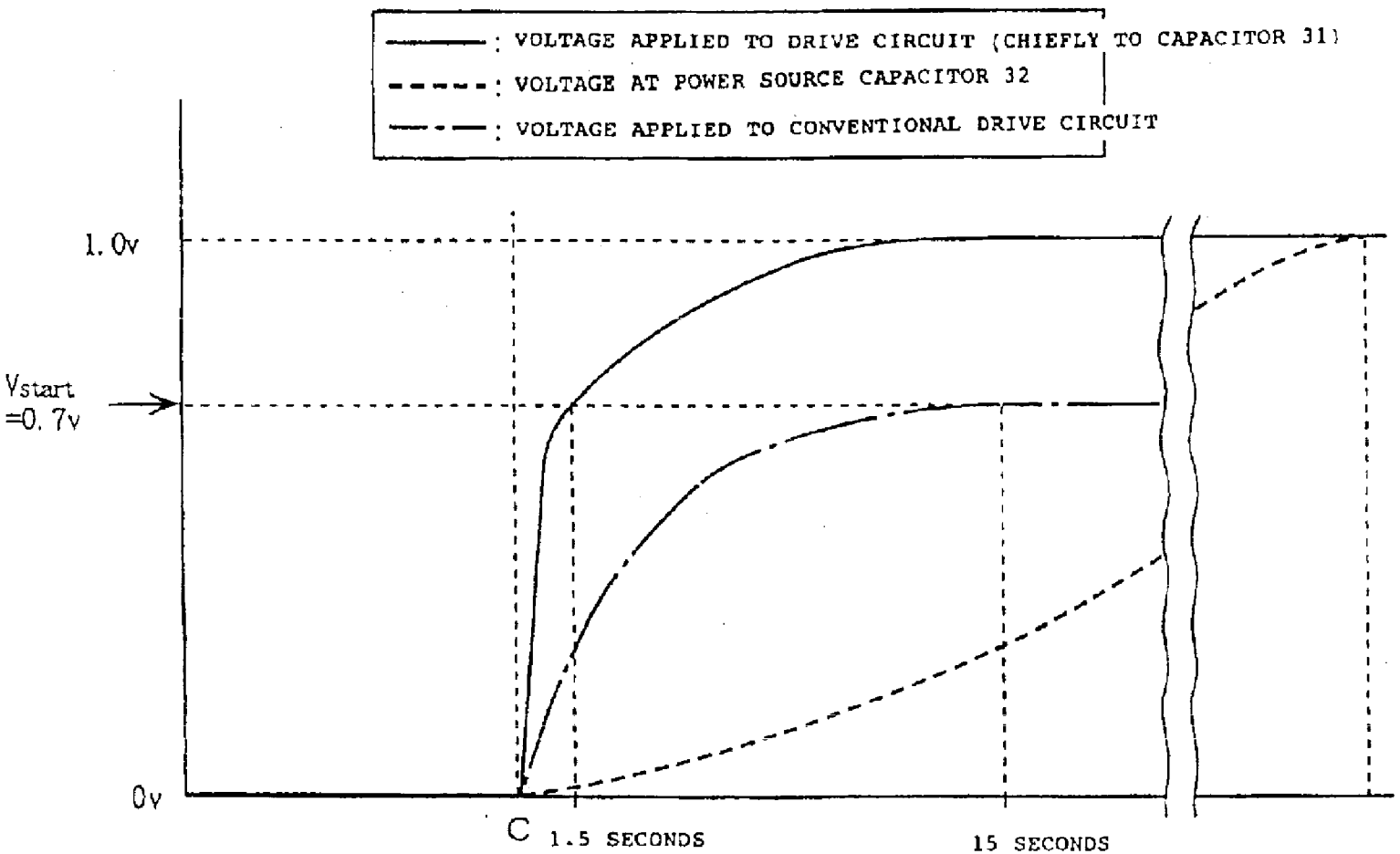
FIG. 21 is a diagram showing variations in the voltage of a capacitor and the voltage applied to a drive circuit in the third embodiment.

The voltage applied to the drive circuit 57 (the voltage of the main capacitor 31) is maintained at the same level as that of the auxiliary capacitor 32 as shown in FIG. 20.

Control during the time correction operation (hand setting operation) is performed as follows.

When the crown is pulled out to the second step from the normal hand driving position for the hand setting operation, the switch 361 is opened in interlock with the pull of the crown (point A in FIG. 20). With the switch 361 opened, almost no power of the auxiliary capacitor 32 is consumed, and the voltage of the capacitor 32 is maintained at a voltage of about 1.0 V.

During the hand setting operation, the generator 20 stops rotating, allowing no charging current to flow into the main capacitor 31. The voltage of the main capacitor 31 rapidly drops by the load of the drive circuit 57. When the voltage of the main capacitor 31 becomes equal to or lower than the voltage Vstop (approximately 0.6 V), the drive circuit 57 stops operating.

When the crown is pushed in to the first step after the hand setting operation, the switch 361 is closed (point B in FIG. 20). A current flows into the main capacitor 31 through the diode 36 from the auxiliary capacitor 32 that is held at a voltage of approximately 1.0 V. Because of a small capacitance thereof, the main capacitor 31 reaches the same voltage (1.0 V) as that of the auxiliary capacitor 32, and feeds electrical energy to the drive circuit 57, thereby causing the oscillator circuit 51 to start operating.

Figure 26:
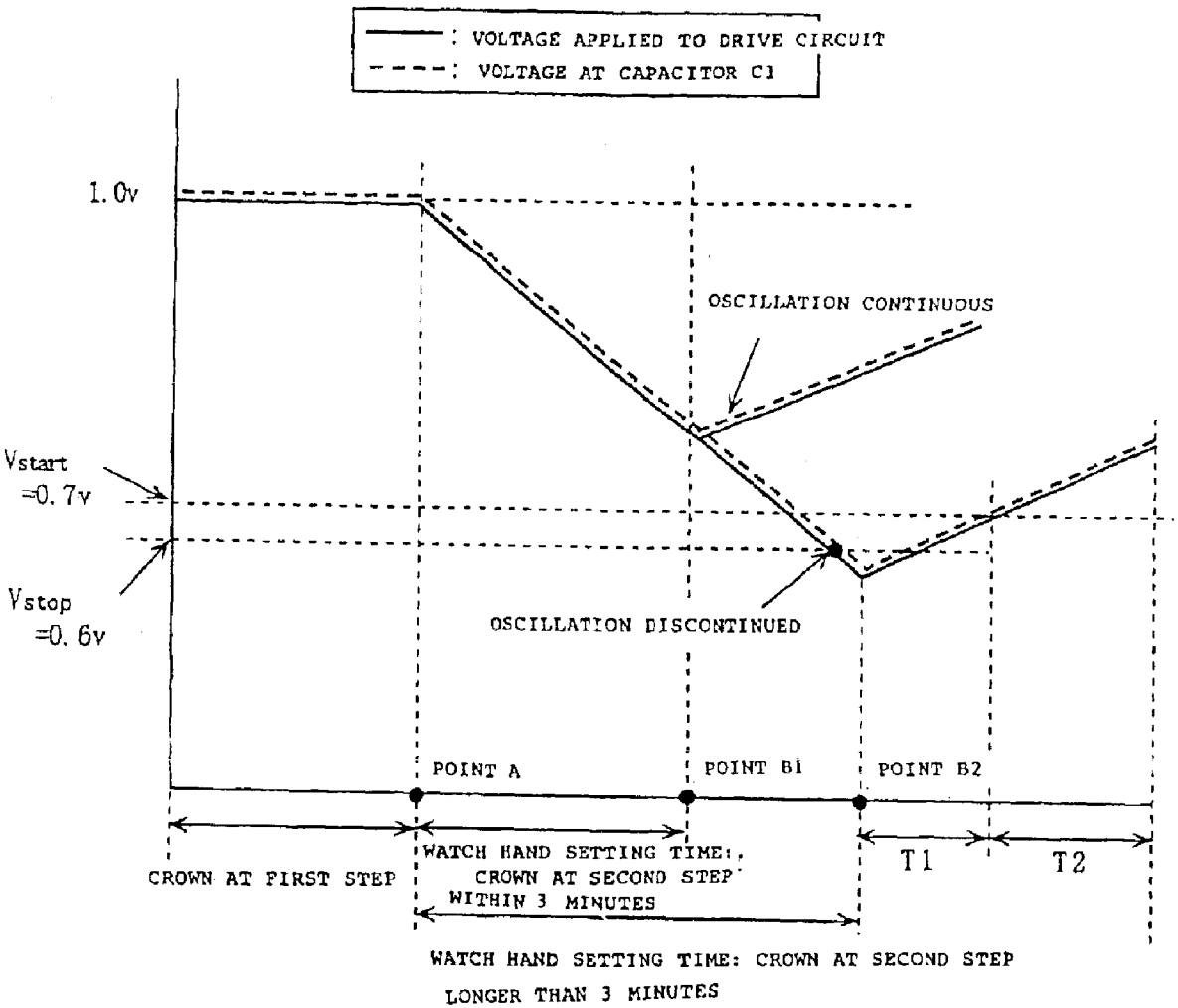
FIG. 26 PRIOR ART
FIG. 26 is a diagram showing variations in the voltage of a capacitor and the voltage applied to a drive circuit a conventional art.
Figure 27:
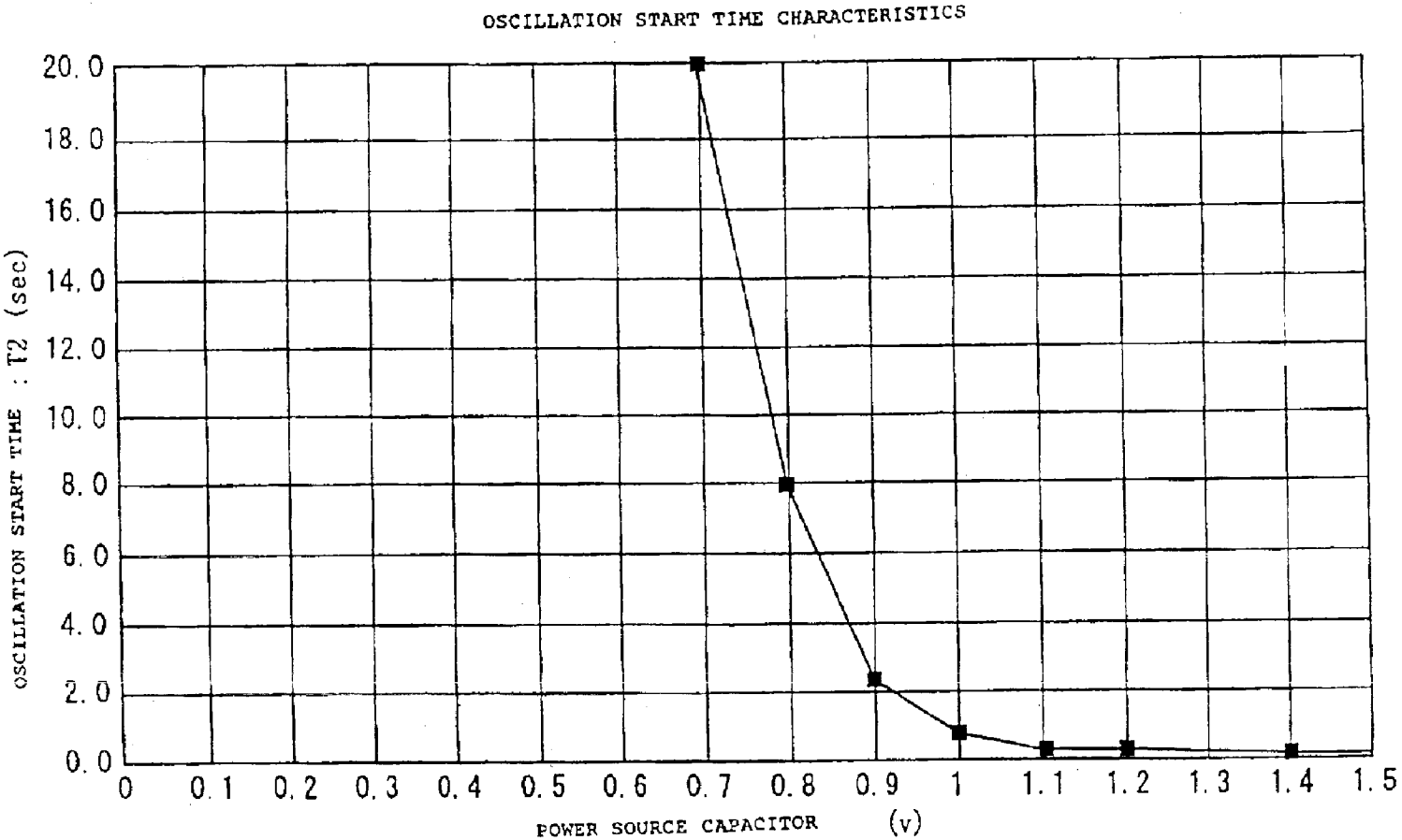
FIG. 27 PRIOR ART
FIG. 27 is a graph showing applied voltage versus oscillation start time characteristics of an oscillator circuit.

Since the oscillator circuit 51 is supplied with a high voltage of 1.0 V as in the second embodiment as shown in FIG. 16, the time Tstart prior to the start of the oscillation (corresponding to the time T2 in the conventional art shown in FIG. 26) is shortened to be approximately 0.8 second (at a temperature of about 20° C.). The duration of time from the push of the crown (point B in FIG. 20) to the voltage of the main capacitor 31 reaching 1.0 V is very short, and thereby the time the oscillator circuit 51 takes to start operating subsequent to the hand setting operation is substantially shortened.

When the hand setting operation takes 10 minutes or longer, or when the voltage of the auxiliary capacitor 32 is zero V or in the vicinity of zero V (down to point C in FIG. 21) with the timepiece left unattended for a long period of time, the main capacitor 31 is also held at almost zero V.

When the switch 361 is closed after the hand setting operation, setting the generator 20 operative (point C in FIG. 21), a major percentage of the current flows into the main capacitor 31 rather than into the auxiliary capacitor 32. Specifically, the diode 36 blocks the charging current of the generator 20 flowing to charge the auxiliary capacitor 32, and the resistor 37 is as high as 100 MΩ. A major percentage of the generated current thus flows into the main capacitor 31 and almost no current flows into the auxiliary capacitor 32. The generator 20 is designed to result in a current within a range from about 100 nA to several 10 $\mu$A with the capacitors 31 and 32 in the vicinity of zero V, and an extremely small current flowing through the resistor 37 is neglected.

The voltage of the main capacitor 31 rapidly rises with the major percentage of the generated current flowing thereinto. Along with this, the main capacitor 31 reaches the oscillation start voltage (Vstart) of the drive circuit 57 (IC) within a short time (approximately 1.5 seconds, for instance) subsequent to the hand setting operation, and the control starts. If no charge control circuit 35 were employed with the current generated by the power supply circuit 30 flowing to both capacitors 31 and 32, the main capacitor 31 would take about 15 seconds to reach the oscillation start voltage of the drive circuit 57. In this embodiment, the main capacitor 31 reaches the oscillation start voltage within one-tenth the time.

After the drive circuit 57 starts driving, a charging current gradually flows into the auxiliary capacitor 32 through the resistor 37. After a sufficiently long period of time has passed, the auxiliary capacitor 32 reaches the same voltage as that of the main capacitor 31 (approximately 1.0 V).

In the normal hand driving state, the auxiliary capacitor 32 serves as a backup for the main capacitor 31 in the event of voltage fluctuations, contributing to stabilizing the power source voltage and the system operation.

The oscillator circuit 51 substantially remains constant at a voltage of approximately 1.0 and the time Tstart to the oscillation is also constant at about 0.8 second, when the auxiliary capacitor 32 holds charge. The control circuit (the brake control circuit) 56 performs brake control by applying a constant quantity correction corresponding to a predetermined value (approximately 0.8 second, for instance) to further reduce the indication error.

When the auxiliary capacitor 32 holds no charge, the voltage applied to the oscillator circuit 51 gradually rises from about 0.7 V, and the time Tstart to the oscillation is substantially constant with about 1.5 seconds (the time required for the main capacitor 31 to rise to Vstart=0.7 V)+20 seconds (the time the oscillator circuit 51 takes to start oscillating when a voltage of 0.7 V is applied thereto). The control circuit 56 performs brake control by applying a constant quantity correction corresponding to a predetermined value (approximately 21.5 seconds, for instance) to further reduce the indication error.

The selection between these correction values is determined by detecting the voltage value applied to the control circuit 56 and the rotation period of the generator 20. Available as a method of setting the correction value is the method of counting time set in a timer or the method of setting a timer in an analog fashion using a CR time constant.

When the generator 20 becomes operative, performing the normal operation, power from the generator 20 is fed to the drive circuit 57 via the main capacitor 31. The rotation control of the generator 20 is thus continuously performed.

This embodiment provides the following advantages.

(3-1) The charge control circuit, composed of passive elements such as the diode 36 and the resistor 37, is employed to control the charging and discharging of the main capacitor 31 and the auxiliary capacitor 32, and compared to the conventional art which employs the comparator, i.e., an active element, power consumption is reduced.

With the comparator dispensed with, the ability of the generator 20 is reduced accordingly. Since a reduced energy supply from the mainspring 1*a* works, time of sustaining energy supply from the fully tightened state of the mainspring 1*a* is thus prolonged. With the size of the generator 20 reduced, the component layout is facilitated within a timepiece body having limited space, and as a result, the timepiece itself is reduced in size. This arrangement finds application in wristwatches, which are subject to the limitation of area and thickness dimensions.

(3-2) The timepiece includes the switch 361, which is opened and closed in response to the push and pull of the crown. When the generator 20 is stopped with the crown pulled out, the auxiliary capacitor 32 supplies no power to the rotation controller 50, and maintains the terminal voltage thereacross.

The auxiliary capacitor 32 feeds a current to the main capacitor 31, namely, the rotation controller 50 immediately subsequent to the start of the generator 20 after the hand setting operation. This embodiment is free from a time lag of the conventional art, i.e., the time lag before the voltage of the power source of the drive circuit (the drive IC) 57 rises high enough to start oscillation. The duration of time, during which the rotation control of the rotor is not performed, is shortened, and the indication error is minimized. The present invention thus assures both the startup capability subsequent to the hand setting and the accuracy of the hand setting at the same time.

When the auxiliary capacitor 32 charges the main capacitor 31, the charging current flows through the diode 36, with a charging loss involved.

(3-3) Since the switch 361 disconnects the auxiliary capacitor 32 from the drive circuit 57, the auxiliary capacitor 32 is maintained at a relatively high voltage (about 1.0 V, for instance). When the switch 361 is closed, the drive circuit 57 is supplied with the high voltage, shortening the time (Tstart) until the oscillator circuit 51 in the rotation controller 50 starts oscillating. The rotation controller 50 is even more rapidly operated, reducing the indication error.

(3-4) A small-capacitance main capacitor 31 is employed, and the charge control circuit 35 is arranged to allow more charging current from the generator 20 to flow into the main capacitor 31, when no charge is stored in the capacitors 31 and 32, for instance, after the timepiece has been left unattended for a long period of time. The time, the main capacitor 31 takes to reach the voltage capable of driving the drive circuit 57 from a zero-volt state thereof, is shortened approximately one-tenth the time required when no charge control circuit 35 is employed. After being left unattended for a long period of time, the present invention thus assures both the startup capability subsequent to the hand setting and the accuracy of the hand setting at the same time.

If the drive circuit 57 is not driven after the hand setting, and no brake is applied on the hand driving at all in a free running state, the second hand moves fast, and the user may have anxiety about and lose confidence in the timepiece. In this embodiment, the drive circuit 57 resumes the driving operation within a short time. There is almost no time during which the second hand moves fast, and the user's confidence in the timepiece is thus maintained.

(3-5) The main capacitor 31 is directly connected to the drive circuit 57, not by way of the mechanically driven switch 361. Even if the mechanically driven switch 361 chatters, the main capacitor 31 continuously feeds power to the drive circuit 57, thereby preventing the drive circuit 57 from being shut down as a result of chattering.

(3-6) Since the auxiliary capacitor 32, having a capacitance larger than that of the main capacitor 31, is connected in parallel with the main capacitor 31, the auxiliary capacitor 32 may back up the main capacitor 31 in the event of voltage fluctuations, contributing to stabilizing the power source voltage and the system operation.

(3-7) Although the time until the drive circuit 57 starts driving subsequent to the hand setting operation becomes different depending on whether the auxiliary capacitor 32 holds charge, the time is controlled to a substantially constant. The indication error is corrected by performing a constant quantity correction using a predetermined value. The indication error is thus minimized, and the accuracy of the hand setting is even further improved.

(3-8) The charge control circuit 35 is composed of low-cost elements, such as the diode 36 and the resistor 37. Compared to the arrangement using a comparator, the manufacturing costs are reduced, and a low-cost timepiece is thus supplied.

(3-9) The control of the charging current to the capacitors 31 and 32 through the charge control circuit 35 is performed by selecting a proper resistance for the resistor 37. Depending on the type of a timepiece, a proper resistance value may be selected.

(3-10) The indication error is corrected through the constant quantity correction control using a predetermined value. The construction of the indication error corrector unit (control circuit) 56 is thus simplified and the cost thereof is accordingly reduced.

Figure 22:
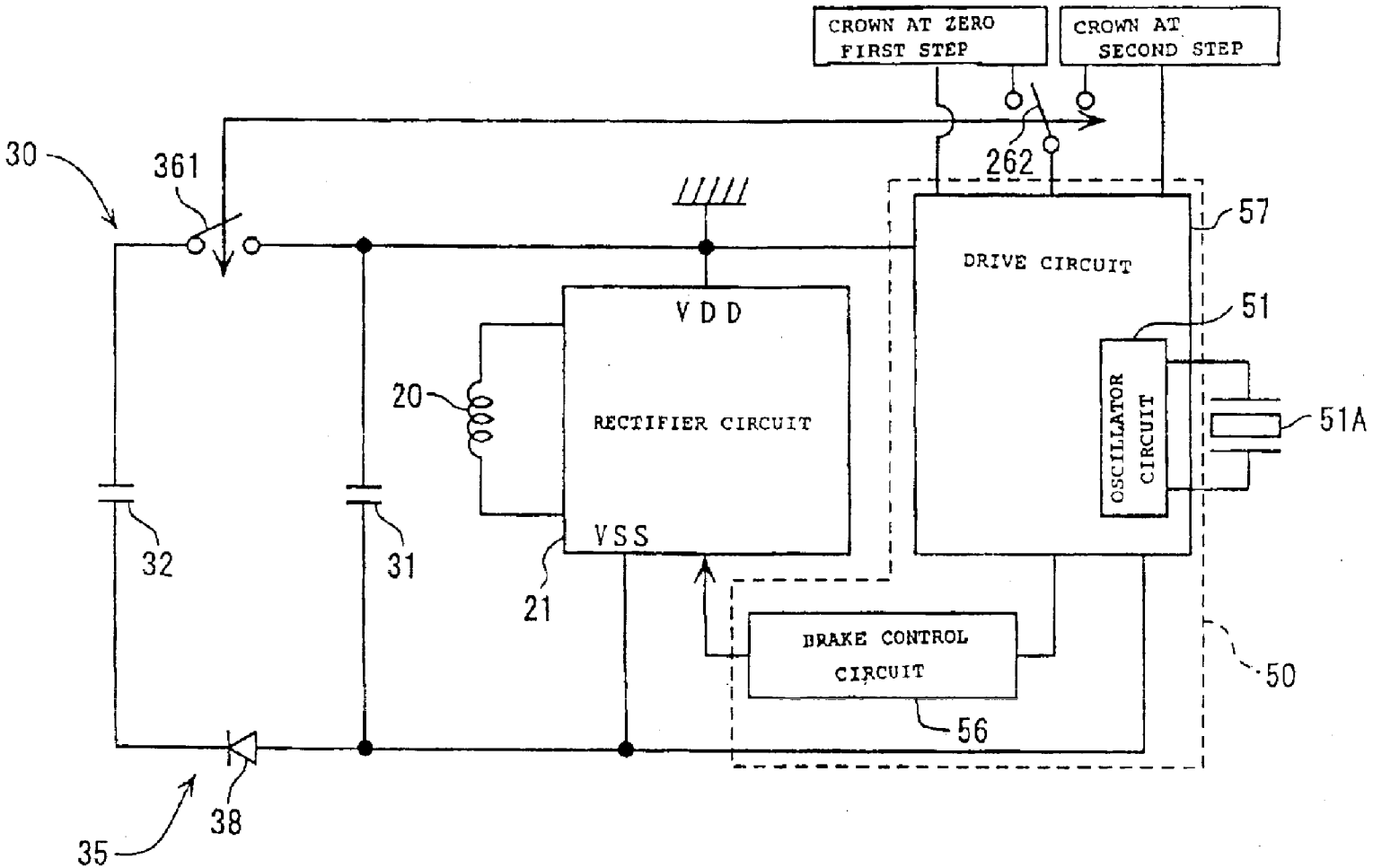
FIG. 22 is a circuit diagram showing the construction of a power supply circuit of a fourth embodiment of the present invention.

A fourth embodiment of the present invention is now discussed, referring to FIG. 22.

In this embodiment, the charge control circuit 35 is constructed of only a diode 38 having a reverse leakage current. In this case, when the generator 20 charges the capacitors 31 and 32, the charging current to the auxiliary capacitor 32 becomes extremely small because the charging current is the reverse leakage current of the diode 38 only. A major percentage of the charging current flows into the main capacitor 31. In the same way as in the preceding embodiment, the main capacitor 31 rapidly rises in voltage, thereby shifting the drive circuit 57 into a control state within a short period of time.

When the auxiliary capacitor 32 holds charge, the auxiliary capacitor 32 feeds a current to the main capacitor 31 through the diode 38. The drive circuit 57 is rapidly driven, with a small current loss involved.

Besides the advantages (3-1) through (3-9) of the third embodiment, the fourth embodiment enjoys a cost reduction, because the diode 38 only is used for the charge control circuit 35.

Figure 23:
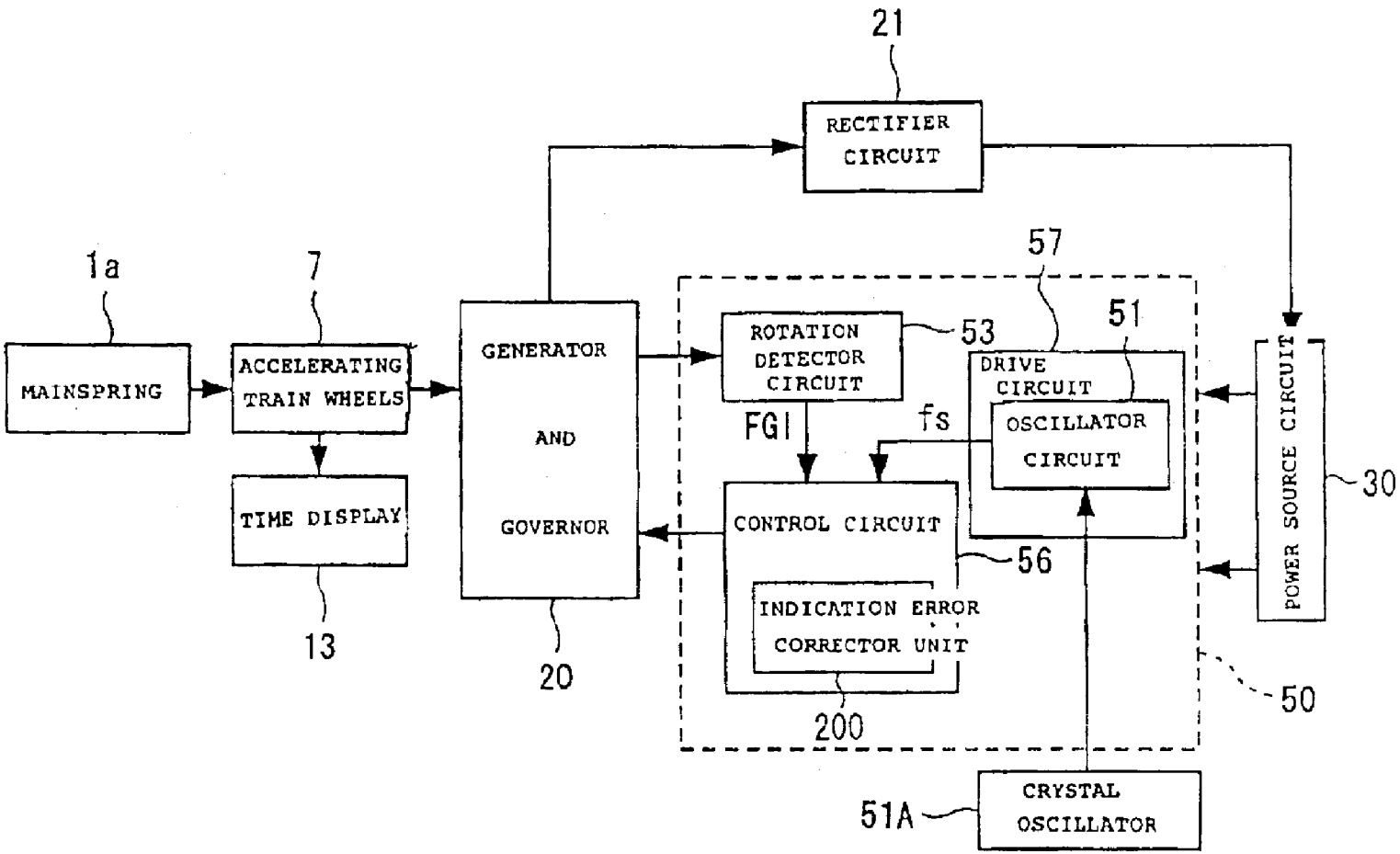
FIG. 23 is a block diagram showing the construction of an electronically controlled timepiece of a fifth embodiment of the present invention.
Figure 24:
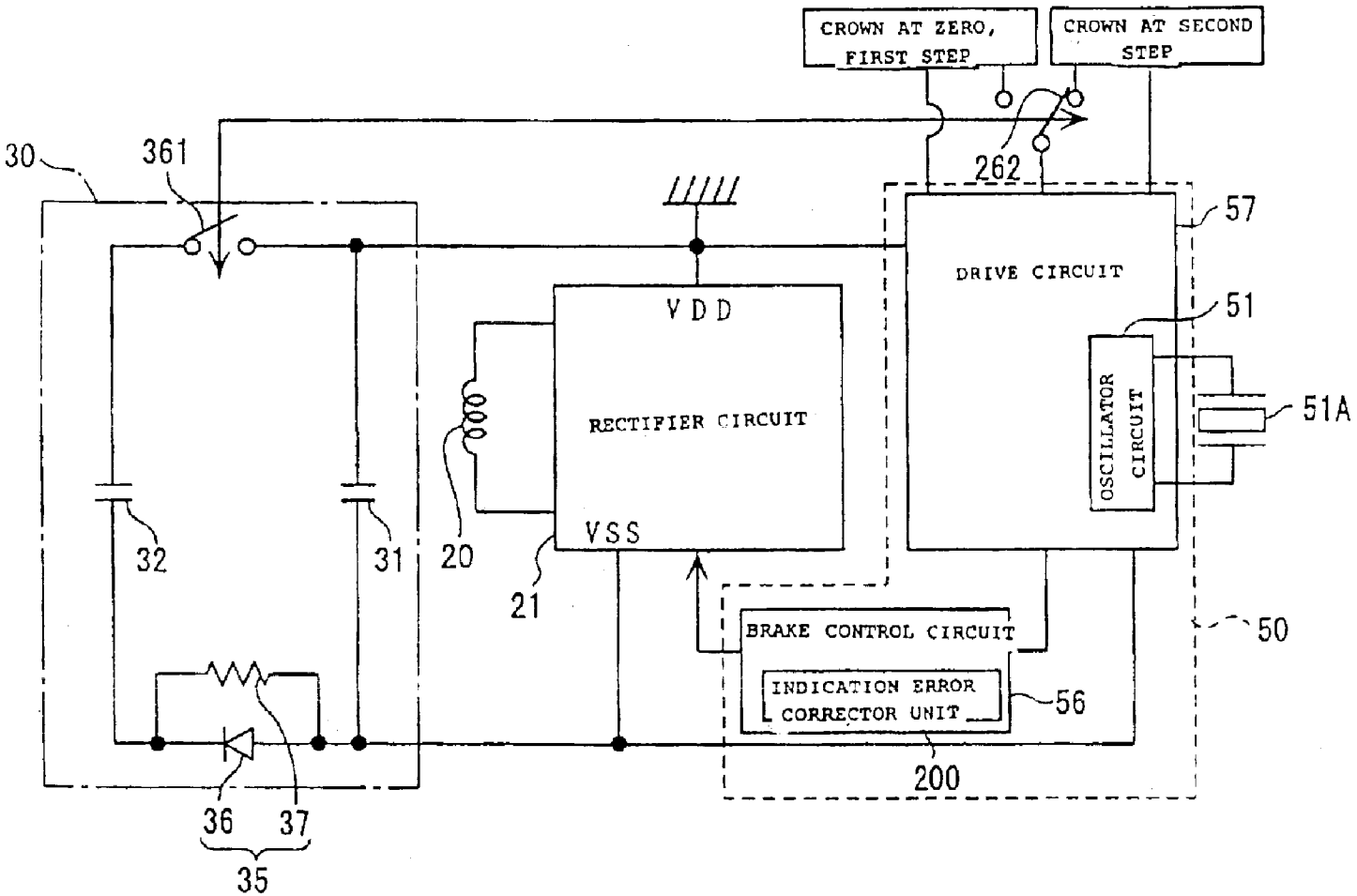
FIG. 24 is a circuit diagram showing the construction of a power supply circuit of the fifth embodiment.

A fifth embodiment of the present invention is now discussed, referring to FIGS. 23 and 24. This embodiment includes the indication error corrector unit 200 in the second embodiment in the control circuit 56 in the third embodiment.

When the switch 361 is closed with the auxiliary capacitor 32 holding charge after the time correction operation, the auxiliary capacitor 32 charges the main capacitor 31 by feeding a current to the main capacitor 31 through the diode 36, thereby very quickly driving the drive circuit 57. In the same way as in the second embodiment, when the drive circuit 57 is driven, the indication error corrector unit 200 performs brake control on the generator 20 taking into account the correction values that account for the oscillation start time and temperature. The indication error is thus removed.

When the switch 361 is closed with the auxiliary capacitor 32 holding no charge, a major percentage of the charging current flows into the main capacitor 31 by way of the charge control circuit 35. In the same way as in the preceding embodiment, the main capacitor 31 rapidly rises in voltage, shifting the drive circuit 57 into a control state within a short period of time. In this case, as well, the indication error is removed, because the indication error corrector unit 200 corrects brake control for the generator 20.

This embodiment enjoys the advantages (2-3) through (2-5) provided by the use of the indication error corrector unit 200 in the second embodiment and advantages (3-1) through (3-9) in the third embodiment.

The present invention is not limited to the above embodiments, and changes and modifications, within which the object of the present invention is achieved, fall within the scope of the present invention.

In the first embodiment, for instance, the power source switch (the power cutoff switch 162) is arranged in the power source VSS. Alternatively, the power source switch may be arranged on the power source VDD or may be arranged on each of the power sources VDD and VSS. It is important that the power source switch cuts off the supply of electrical energy to the analog circuit 160 to reduce the power consumption, and the position of and the construction of the power source switch may be arbitrarily set.

The power source switch (the power cutoff switch 162) is not limited to the one that is driven by a signal from the crown detector circuit 180. The power source switch may be a mechanically driven switch that operates in interlock with the operation of the crown. Alternatively, the power source switch may be opened and closed in interlock with the stop and activation of the generator 20 or the train wheels. It is important that the power source switch be opened and closed in interlock with the hand setting operation.

The clock input limiting means (the clock cutoff gate 171) is not limited to the AND gate in the first embodiment. Alternatively, the clock input limiting means may be a switch that connects or disconnects the signal line between the oscillator circuit 51 and the logic circuit 170. It is important that the clock input limiting means block the clock input to the logic circuit 170.

Unlike the first embodiment, the selection switch 186 in the crown detector circuit 180 is configured so that the second signal line 184 is connected to the zero and first steps and that the first signal line 183 is connected to the second step. In this case, the output signal of the crown detector circuit 180 is inverted, and the power cutoff switch 162 and the clock cutoff gate 171 need to be configured in accordance with the output signal.

The signal input line 185 of the crown is connected to the power source VDD in the first embodiment. Alternatively, the signal input line 185 is connected to the power source VSS side. In this case, the crown detector circuit 180 is configured so that the crown position may be detected by the closing of the switch 186 connected to the power source VSS.

The switch 186 may be configured to continuously connect to the signal line 183 or 184 with the crown placed in each step. With the two inverters 181 and 182 thereof, the crown detector circuit 180 sustains the signal input from the switch 186. The switch 186 may be instantaneously put into contact with one of the signal lines 183 and 184 when the crown is switched, and may be held in an intermediate position remaining unconnected to any of the signal lines 183 and 184 until the crown is switched next.

Figure 28:
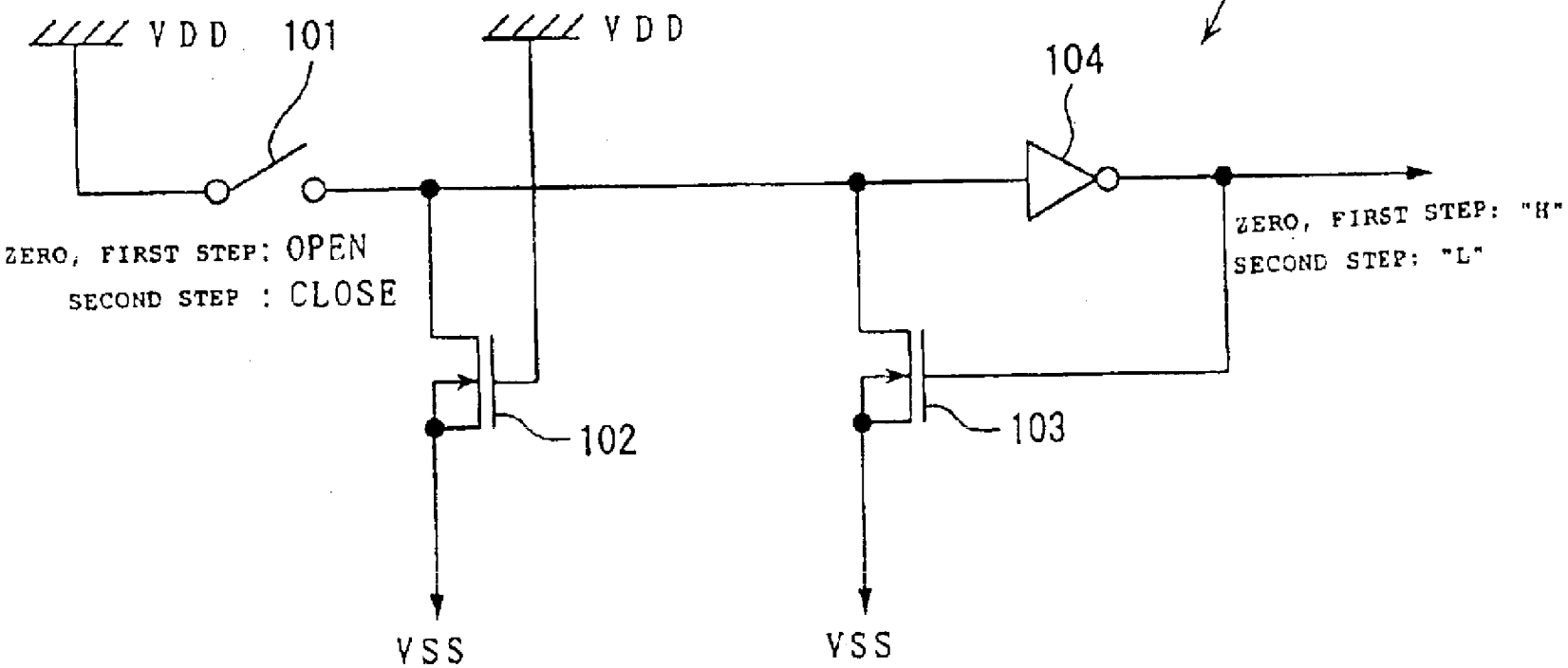
PRIOR ART FIG. 28
FIG. 28 is a circuit diagram showing a conventional crown detector circuit.

The external control member detector circuit (the crown detector circuit 180) is not limited to the construction of the preceding embodiments. The external control member detector circuit may be a conventional crown detector circuit shown in FIG. 28. The use of the crown detector circuit 180 of the preceding embodiments further reduces power consumption.

The external control member for switching between the hand setting mode and the normal hand driving mode is not limited to the crown, and may be a dedicated button or lever. The external control member may be a mechanically driven one or an electrical one. A suitable control member may be selected. Furthermore, the external control member detector circuit is not limited to the one for detecting the voltage as in the preceding embodiments. The external control member detector circuit may directly detect the position of the external control member using a lever or a push button, which moves along with the external control member. In accordance with the type of the external control member, the external control member circuit may be appropriately set up.

The power supply circuit for driving the logic circuit is not limited to the constant voltage regulator 161, and any circuit capable of driving the logic circuit is acceptable.

In the first embodiment, the registers of pre_RYZ (for the previous crown position data) and now_RYZ (for the present crown position data) are arranged to determine whether there is any change in the crown position (step S4 in FIG. 8). Alternatively, only now_RYZ (for the present crown position data) may be arranged, and steps S1, S3, S4, and S5 in FIG. 8 may be eliminated to proceed from the detection of the crown position (S2) directly to the determination of the crown position (S6). In the first embodiment, a change in the crown position is determined, and only when there is any change, the power supply control process (S7 through S12) is performed for efficient control.

The first embodiment of the present invention may be implemented in a self-winding generator timepiece, a solar-cell charging timepiece, or a battery driven timepiece, other than the electronically controlled mechanical timepiece. In these timepieces, the power consumption during the hand setting operation is reduced. The driving time is prolonged, while the indication error is eliminated because the oscillator circuit continuously works.

In the second and fifth embodiments, the indication error corrector unit 200 in the control circuit 56 detects the voltage applied to the capacitor 22 and the temperature thereof, and corrects the indication error by the correction value that accounts for the detected voltage and temperature. As in the third embodiment, the indication error may be corrected by a constant quantity correction corresponding to the predetermined value.

The correction of the indication error may be performed by only the voltage of the capacitor 22, or in response to the rotation period of the generator 20. For instance, the voltage of the capacitor 22 is detected to perform correction in accordance with the correction value responsive to the voltage value. When the voltage held by the capacitor 22 is as high as 1.2 V, the correction value may be "0", and when the voltage held by the capacitor 22 is as low as 0.8 V, the correction value may be minus 1.0 second (−1.0 second).

The charge voltage to the capacitor 22 is typically proportional to the torque of the mainspring 1*a* applied to the generator 20, and the torque determines the rotation speed of the hand. A check is made to determine the correspondence between the voltage value of the capacitor 22 and the fast/slow position of the hand at the start time at which the brake control starts with the oscillator circuit 51 driven by the voltage value of the capacitor 22. The correspondence table between the voltage value and the hand indication error may be stored in the control circuit 56 or other circuit.

For instance, when the capacitor 22 is at 1.2 V, the hand position is free from a fast/slow error (no indication error) at the start time at which the brake control starts (approximately 0.2 second later). By setting the correction value to zero, the indication error is almost removed.

When the capacitor 22 is at 0.8 V, the hand has been driven (moved) by 9 seconds by the start of the brake control (the time to the oscillation, and approximately 8 seconds). By setting a correction of the difference of 1 second in the brake control, the indication error is almost removed.

The indication error corrector unit 200 is not limited to the arrangement in which the initial value is set in the up/down counter 54 in the second embodiment. For instance, the output value LBS of the up/down counter 54 may be directly adjusted for correction. Another brake circuit for correction, different from the normally used brake circuit 120, may be arranged. It is important that the timepiece be constructed to correct the indication error thereof.

The specific construction of the switch 261, namely, the power supply control unit, may be properly arranged. The power supply control unit is not limited to the mechanically driven switch, and may be an electrical switch. To reliably cut off the supply of power, the mechanically driven switch is preferable. Even when the electrical switch is employed, merely a leakage current (as large as approximately 1 nA) of a silicon diode forming the electrical switch is discharged, and the switch cutoff effect thereof is almost identical to that of the mechanically driven switch. The electrical switch practically presents no problems.

The switch 261 is not limited to the switch which is opened and closed in interlock with the operation of the crown (the time correction operation). Alternatively, the switch 261 may be a switch which is opened and closed in interlock with the stop and activation of the generator 20 or the train wheels. Interlocked with the operation of the crown, the switch 261 advantageously has a simple and low-cost construction.

Figure 25:
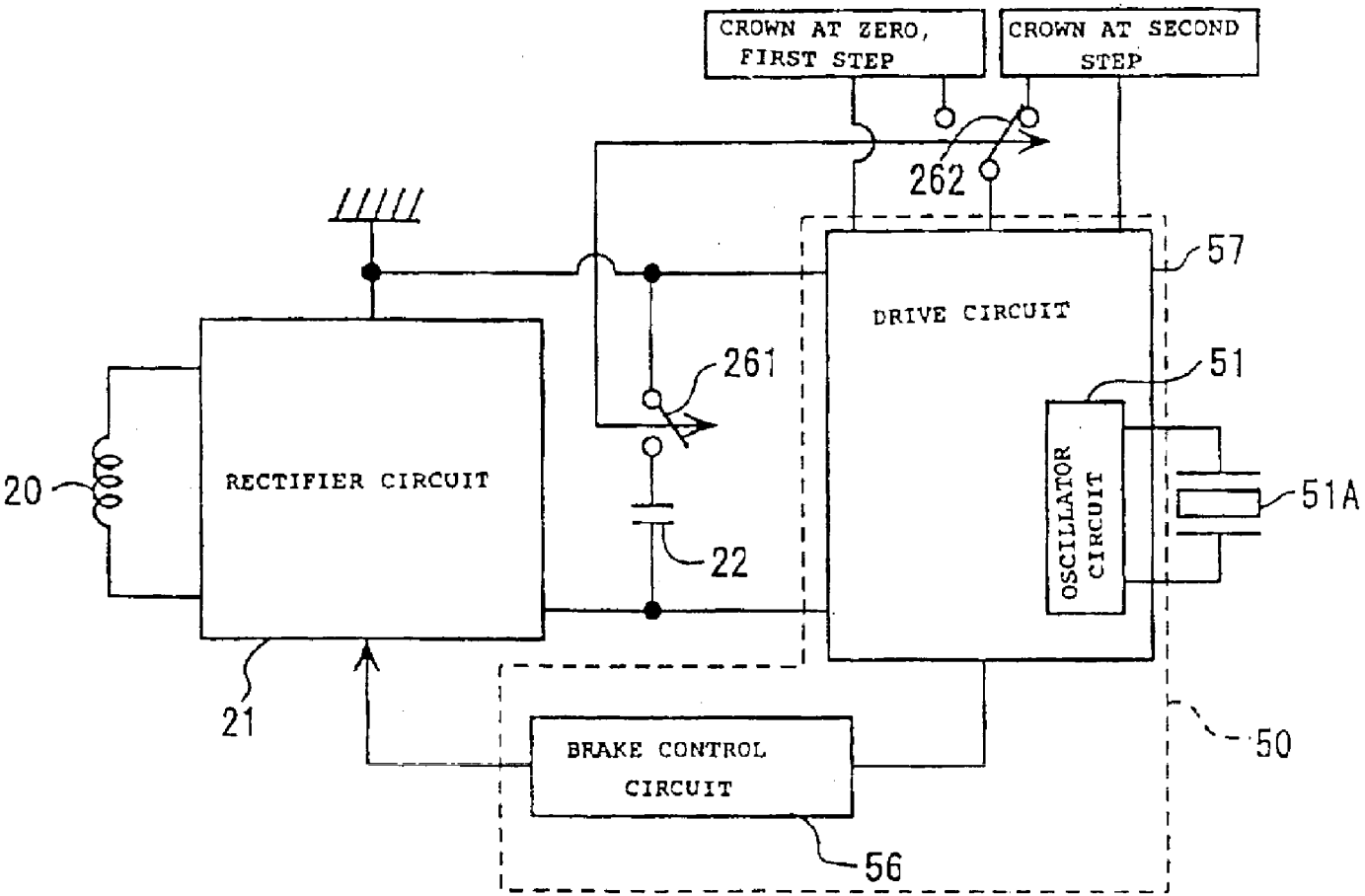
FIG. 25 is a circuit diagram showing an modification of the second embodiment.

In the second embodiment, the use of the second capacitor 25 is not a requirement. As shown in FIG. 25, the second capacitor 25 is dispensed with, and the capacitor 22 only may be used.

The charge control circuit 35 is not limited to the ones in the third and fourth embodiments. The charge control circuit 35 may be constructed of a one-way element and a resistor. A diode having no reverse leakage current may be used for the one-way element. In this case, the one-way element works like the diode 36 in the third embodiment, and the resistor works like the resistor 37, and the advantages (3-1) through (3-9) of the third embodiment are equally enjoyed.

An active element, such as a comparator, may be used for the charge control circuit 35. The charge control circuit 35 allows more charging current from the generator 20 to the main capacitor 31, and less charging current to flow to the auxiliary capacitor 32. When the voltage of the auxiliary capacitor 32 is higher than that of the main capacitor 31, the auxiliary capacitor 32 supplies a current to the main capacitor 31. To this end, the charge control circuit 35 is configured to adjust the charging current of the main storage unit and the auxiliary storage unit, and the direction and magnitude of the current flowing between the main storage unit and the auxiliary storage unit. The charge control circuit 35 constructed of passive elements only is preferable in view of a reduction in power consumption.

The control circuit 56 in the third and fourth embodiments corrects the indication error by the constant quantity correction corresponding to a predetermined constant value. Alternatively, as in the second embodiment, the indication error corrector unit 200 may be arranged to perform the correction in response to the voltage value, temperature, and the rotation period of the generator 20. Furthermore, in the third and fourth embodiments, the use of the indication error corrector unit 200 is not a requirement. In this case, when temperature is extremely low, or when the voltage of the auxiliary capacitor 32 drops, the oscillator circuit 51 takes time to start oscillating, and an indication error is accordingly created. However, the indication error is removed in the course of the hand driving control. Specifically, with the indication error corrector unit 200 incorporated, the time required to remove the indication error is substantially shortened subsequent to the time correction operation. On the other hand, when the indication error corrector unit 200 is not arranged, the time required to remove the indication error is mildly prolonged. But this degree of time prolongation is not problematic in practice, because the indication error is removed within 1 to several minutes. When the voltage of the auxiliary capacitor 32 is assured with temperature not substantially low, the time the oscillator circuit takes to start oscillating is typically short, and the indication error is removed without the need for the indication error corrector unit 200.

The specific construction of the switch 361 may be appropriately set up. The switch 361 is not limited to the one which is opened and closed in interlock with the operation of the crown. The switch 361 may be opened and closed in interlock with the stop and activation of the generator 20 or the train wheels. However, if the switch 361 is interlocked with the operation of the crown, it will be manufactured simply and for a low cost.

The types, the reverse leakage currents, and the resistances of the diodes 36 and 38, and the resistor 37 may be appropriately determined in design. Particular attention needs to be given to the resistance of the resistor 37 and the reverse leakage current of the diode 38, because these affect the magnitude of the charging current of the auxiliary capacitor 32.

In the first embodiment, the indication error corrector unit 200 may be included in the control circuit 56 as in the second embodiment. The power supply circuit 30 in the third and fourth embodiments may be arranged as a power supply circuit in the first embodiment. In the first embodiment, even when the generator 20 stops during the time correction operation, the oscillator circuit 51 continuously remains operative from power from the capacitor 22. The timepiece of the first embodiment is free from the indication error at the shifting back from the time correction operation. However, an indication error takes place when the capacitor 22 is discharged to the extent that the oscillator circuit 51 becomes inoperative if a time correction operation takes time or if the timepiece has been left unattended for a long period of time. With the power supply circuit 30 incorporated, the oscillator circuit 51 quickly restarts, reducing the indication error at the moment the generator 20 becomes operative, even when the capacitor 22 is discharged. With the indication error corrector unit 200 further incorporated, the indication error at the restart of the oscillator circuit 51 is even more reduced.

In each of the above embodiments, two types of chopping signals CH3 having different duty factors are input to the switch 121 for brake control. The brake control may be performed by inputting an inverted LBS signal, rather than using the chopping signal. In each of the above embodiments, the brake control is performed by making a closed loop between the terminals MG1 and MG2 in the generator 20 to carry out a short-circuit brake. Alternatively, the brake control may be performed by connecting a variable resistor to the generator 20 to vary a current flowing through the coil of the generator 20. Consequently, the specific construction of the brake control circuit 56 is not limited to the arrangement shown in FIG. 2, and may be appropriately set up.

The mechanical energy source for driving the generator 20 is not limited to the mainspring 1*a*, and may be a rubber member, a spring, a weight, or a fluid such as compressed air. An appropriate mechanical energy source may be selected in accordance with an apparatus in which the present invention is implemented. Means for feeding mechanical energy to the mechanical energy source may be manual winding, an oscillating weight, potential energy, pressure variations, wind force, wave power, hydraulic power, or temperature differences.

Mechanical energy transmission means for transmitting mechanical energy from the mechanical energy source such as, a mainspring to the generator is not limited to the train wheels 7 (gears), and may be a frictional wheel, a belt (such as a timing belt), a pulley, a chain, a sprocket wheel, a rack and pinion, or a cam. The mechanical energy transmission means is appropriately set up in accordance with the type of the electronically controlled timepiece in which the present invention is implemented.

The generator is not limited to the one which generates power through electromagnetic conversion by rotating the rotor. Alternatively, the generator may be a generator of a different type, such as a piezoelectric generator which adds pressure to a piezoelectric element.

The time display unit is not limited to the hand 13, and may be a disk, a ring-shaped member or a sector member. The time display unit may be a digital display unit employing a liquid-crystal display panel.

Industrial Applicability

As discussed above, the time indication error is reduced in the electronically controlled timepiece of the present invention, the power supply control method for the electronically controlled timepiece, and the time correction method for the electronically controlled timepiece.

In the electronically controlled timepiece and the power supply control method therefor in accordance with a first invention, the use of the power source switch and the clock input limiting means reduces the power consumption involved in the time correction operation (the hand setting operation). Since the oscillator circuit continuously remains operative during the time correction operation, a time indication error at the time of shifting back from the time correction operation is eliminated.

In the electronically controlled timepiece and the time correction method therefor in accordance with a second invention, increasing the capacitance of the capacitor and the size of the mechanical energy source is not required. The electronically controlled timepiece is thus miniaturized with costs thereof reduced. Even when the time correction operation (the hand setting operation) takes time, the time the oscillator circuit takes to start oscillating is shortened. Since the indication error corrector unit corrects the indication error, the indication error of the hand subsequent to the time correction operation is minimized.

In the electronically controlled timepiece and the power supply control method therefor in accordance with a third invention, the rotation controller is quickly driven to reduce an error in the time control when the generator starts generating. Furthermore, the passive elements, such as a diode and a resistor, are used for the charge control circuit, the power consumption involved therein and the power generating capacity may be small, compared with the arrangement in which an active element, such as a comparator, is employed.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An electronically controlled timepiece comprising:

a mechanical energy source;

a generator driven by the mechanical energy source, and effective for outputting electrical energy;

a rotation controller driven by electrical energy, and effective for controlling a rotation period of the generator;

a main storage unit for storing electrical energy supplied by the generator to drive the rotation controller;

an auxiliary storage unit connected in parallel with the main storage unit through a mechanically driven switch that is responsive to a time correction operation; and a charge control circuit arranged between the main storage unit and the auxiliary storage unit, said charge control circuit being effective for adjusting charging currents to the main storage unit and the auxiliary storage unit, and for controlling a direction and a magnitude of a current flow between the main storage unit and the auxiliary storage unit.

2. An electronically controlled timepiece according to claim 1, wherein:

the charge control circuit makes the charging current to the auxiliary storage unit smaller than the charging current to the main storage unit when the mechanically driven switch is closed to charge the main storage unit and the auxiliary storage unit with electrical energy from the generator; and the charge control circuit further allows the auxiliary storage unit to charge the main storage unit when the voltage of the auxiliary storage unit is higher than the voltage of the main storage unit.

3. An electronically controlled timepiece according to claim 2, wherein the charge control circuit comprises a passive element only.

4. An electronically controlled mechanical timepiece according to claim 1, wherein the main storage unit has a capacitance set substantially equal to or lower than a capacitance of the auxiliary storage unit.

5. An electronically controlled timepiece according to claim 1, wherein the mechanically driven switch is opened during the time correction operation, and is closed at the end of the time correction operation.

6. An electronically controlled timepiece according to claim 1, wherein the charge control circuit comprises a resistor and a diode connected in parallel with the resistor; and wherein the diode is configured with the reverse direction thereof aligned with the direction of a current charging the auxiliary storage unit from the generator, and the forward direction thereof aligned with the direction of a current of the auxiliary storage unit charging the main storage unit.

7. An electronically controlled timepiece according to claim 1, wherein the charge control circuit comprises only a diode having a reverse leakage current, and wherein the diode is configured with the reverse direction thereof aligned with the direction of a current charging the auxiliary storage unit from the generator and the forward direction thereof aligned with the direction of a current of the auxiliary storage unit charging the main storage unit.

8. An electronically controlled timepiece according to claim 1, wherein the charge control circuit comprises a resistor and a one-way element connected in parallel with the resistor; and wherein the one-way element is configured to cut off a current flowing in a direction to charge the auxiliary storage unit from the generator and to conduct a current of the auxiliary storage unit flowing in a direction to charge the main storage unit.

9. An electronically controlled timepiece according to claim 1, further including an indication error corrector unit for correcting an error in time indication until the rotation controller resumes a normal operation when the supply of electrical energy of the main storage unit to the rotation controller is restarted with the mechanically driven switch closed.

10. An electronically controlled timepiece according to claim 9, wherein the indication error corrector unit is designed to perform a constant quantity correction corresponding to a predetermined value.

11. An electronically controlled timepiece according to claim 9, wherein the indication error corrector unit sets a correction value in accordance with a voltage of the storage unit.

12. An electronically controlled timepiece according to claim 9, wherein the indication error corrector unit adjusts a correction value in response to detected temperature.

13. An electronically controlled timepiece according to claim 9, wherein the indication error corrector unit includes:

a temperature sensor;

a voltage detector for measuring a voltage of the storage unit;

a correction value setter for setting a correction value based on values detected by the temperature sensor and the voltage detector.

14. A power supply control method for an electronically controlled timepiece having a mechanical energy source, a generator for outputting electrical energy and driven by the mechanical energy source, and a rotation controller for controlling the rotation period of the generator and driven by electrical energy, the power supply control method comprising:

a step of connecting an auxiliary storage unit in parallel with a main storage unit through a mechanically driven switch, wherein the main storage unit stores electrical energy supplied by the generator to drive the rotation controller;

a step of opening the mechanically driven switch during a time correction operation of the electronically controlled timepiece; and a step of flowing a current from the auxiliary storage unit to the main storage unit to charge the main storage unit when the voltage of the auxiliary storage unit is higher than the voltage of the main storage unit with the mechanically driven switch closed at the end of the time correction operation; and a step of making a charging current supplied from the generator to the main storage unit greater than a charging current supplied from the generator to the auxiliary storage unit when the voltage of the auxiliary storage unit is not higher than the voltage of the main storage unit.

15. A timepiece comprising:

a first power rail and a second power rail;

a power generator selectively placed in an active mode in which power is supplied to said first and second power rails and in an inactive mode in which power is not supplied to said first and second power rails;

a first power storage device for receiving power from said power generator through said first and second power rails;

a second power storage device coupled between said first and second power rails;

a first power load coupled to said first power storage device;

a second power load couple to said first power storage device, said second power load being a voltage regulator having an output coupled to a third power rail to provide a regulated output voltage on said third power rail;

a pulse generator coupled to said third power rail for receiving said regulated output voltage, said pulse generator having a clock output for producing a clocking signal when the voltage of said third power rail is above a minimum active voltage level;

a digital circuit coupled to said third power rail for receiving said regulated output voltage and having a clock input selectively coupled to said clock output;

wherein said first power load is decoupled from said first power storage device and said clock input is decoupled from said clock output when said power generator is in said inactive mode;

a current-flow-discriminating circuit effective for providing a first impedance to current flow in one direction and a second impedance to current flow in an opposite direction, said first impedance being greater than said second impedance;

wherein said first storage device is coupled to said second storage device through said current-flow-discriminating circuit; and wherein said current-flow-discriminating circuit is arranged to provide said first impedance to the flow of current from said second power storage device to said first power storage device, and arranged to provide said second impedance to current flow from said first power storage device to said second power storage device.

16. The timepiece of claim 15, wherein said current-flow-discriminating circuit includes a diode.

17. The timepiece of claim 16, wherein said current-flow-discriminating circuit includes a resistor in parallel with said diode.

18. The timepiece of claim 15, wherein said power generator is connected directly to said second power storage device.

19. The timepiece of claim 15 wherein said first and second power storage devices are respective first and second capacitors.

20. The timepiece of claim 19, wherein said first capacitor has a greater capacitance than said second capacitor.

21. The timepiece of claim 15, wherein said first power storage device is decoupled from at least one of said first and second power rails during said inactive mode and is re-coupled to said first and second power rails in response to said active mode.

22. The timepiece of claim 21, wherein said power generator is connected directly to said second power storage device.

23. The timepiece of claim 21 wherein said first and second power storage devices are respective first and second capacitors.

24. The timepiece of claim 23, wherein said first capacitor has a greater capacitance than said second capacitor.

25. The timepiece of claim 21, wherein said current-flow-discriminating circuit includes a diode.

26. The timepiece of claim 25, wherein said current-flow-discriminating circuit includes a resistor in parallel with said diode.

27. The timepiece of claim 15, wherein said power supply is effective for providing electrical power to a time piece.

28. The timepiece of claim 15, further including a user-controlled mode selector for selectively placing said power generator in said active mode and in said inactive mode, said user-controlled mode selector including:

a first inverter and a second inverter;

a first signal line for connecting the output of said first inverter to the input of said second inverter;

a second signal line for connecting the output of said second inverter to the input of said first inverter; and a switch for connecting a signal input line to one of said first and second signal lines to indicate said inactive mode, and for connecting said signal input line to the other of said first and second signal lines to indicate said active mode.

* * * * *